US010107093B2

(12) United States Patent
Yeh et al.

(10) Patent No.: US 10,107,093 B2
(45) Date of Patent: Oct. 23, 2018

(54) DOWNHOLE SAND CONTROL ASSEMBLY WITH FLOW CONTROL AND METHOD FOR COMPLETING A WELLBORE

(71) Applicants: Charles S. Yeh, Spring, TX (US); Michael D. Barry, The Woodlands, TX (US); Michael T. Hecker, Tomball, TX (US)

(72) Inventors: Charles S. Yeh, Spring, TX (US); Michael D. Barry, The Woodlands, TX (US); Michael T. Hecker, Tomball, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 334 days.

(21) Appl. No.: 15/204,076

(22) Filed: Jul. 7, 2016

(65) Prior Publication Data

US 2017/0044878 A1 Feb. 16, 2017

Related U.S. Application Data

(60) Provisional application No. 62/203,000, filed on Aug. 10, 2015, provisional application No. 62/203,001, filed on Aug. 10, 2015.

(51) Int. Cl.
*E21B 43/04* (2006.01)
*E21B 47/10* (2012.01)
(Continued)

(52) U.S. Cl.
CPC ..... *E21B 47/1015* (2013.01); *E21B 43/088* (2013.01); *E21B 43/12* (2013.01); *E21B 43/14* (2013.01)

(58) Field of Classification Search
CPC ..... E21B 43/04; E21B 43/08; E21B 43/12
See application file for complete search history.

(56) References Cited

U.S. PATENT DOCUMENTS 5,588,487 A 12/1996 Bryant
7,661,476 B2 2/2010 Yeh et al.
(Continued)

FOREIGN PATENT DOCUMENTS

WO WO 2007/126496 11/2007
WO WO 2008/060479 5/2008
(Continued)

OTHER PUBLICATIONS

Barry, M. D. et al., "*Openhole Gravel Packing with Zonal Isolation*," SPE Paper No. 110460 (Nov. 2007), pp. 1-10.
(Continued)

*Primary Examiner* — Robert E Fuller
(74) *Attorney, Agent, or Firm* — ExxonMobil Upstream Research Company—Law Department

(57) ABSTRACT

A sand screen assembly offering alternate flow path technology for gravel slurry is provided. The sand screen assembly utilizes transport conduits along an outer diameter of a base pipe for transporting gravel slurry from sand screen to sand screen, thereby providing for a consistent gravel packing along the wellbore. The assembly also includes a unique in-flow control section. The in-flow control section allows the operator to restrict or control the flow of production fluids into the sand screen assembly once a gravel packing operation is completed. Multiple assemblies may be connected using a unique coupling assembly. A method for completing a wellbore in a subsurface formation using the sand screen assembly is also provided herein.

53 Claims, 17 Drawing Sheets

(51) Int. Cl.

| | |
|---|---|
| ***E21B 43/08*** | (2006.01) |
| ***E21B 43/14*** | (2006.01) |
| ***E21B 43/12*** | (2006.01) |

(56) References Cited

U.S. PATENT DOCUMENTS

| | | | |
|---|---|---|---|
| 7,708,068 | B2 | 5/2010 | Hailey, Jr. |
| 7,938,184 | B2 | 5/2011 | Yeh et al. |
| 7,971,642 | B2 | 7/2011 | Yeh et al. |
| 7,984,760 | B2 | 7/2011 | Haeberle et al. |
| 8,011,437 | B2 | 9/2011 | Yeh et al. |
| 8,127,831 | B2 | 3/2012 | Haeberle et al. |
| 8,186,429 | B2 | 5/2012 | Yeh et al. |
| 8,215,406 | B2 | 7/2012 | Dale et al. |
| 8,347,956 | B2 | 1/2013 | Yeh et al. |
| 8,356,664 | B2 | 1/2013 | Yeh et al. |
| 8,430,160 | B2 | 4/2013 | Yeh et al. |
| 8,789,612 | B2 | 7/2014 | Haeberle et al. |
| 2007/0126496 | A1 | 6/2007 | Kawamura et al. |
| 2010/0000740 | A1 | 1/2010 | Dale et al. |
| 2015/0027700 | A1 | 1/2015 | Riisem et al. |

FOREIGN PATENT DOCUMENTS

| | | |
|---|---|---|
| WO | WO 2012/082303 | 6/2012 |
| WO | WO 2012/082447 | 6/2012 |

OTHER PUBLICATIONS

Barry, M. D. et al., "*Advancements in Openhole Completion Technology—Establishing and Sustaining Differentiating Sand Control Completion Performance*," International Petroleum Technology Conference, IPTC Conference Paper 14644 (Feb. 2012), pp. 1-10.

Barry, M. D. et al., "*True Zonal Isolation in Openhole Alternate Pate Gravel Pack Completions*," SPE Conference, SPE Paper No. 151171 (Mar. 2012), pp. 1-9.

Hecker, M. T. et al., "*Extending Openhole Gravel-Packing Capability: Initial Field Installation of Internal Shunt Alternate Path Technology*," SPE Annual Technical Conference and Exhibition, SPE Paper No. 135102 (Sep. 2010), pp. 1-9.

Hecker, M. T. et al., "*First Installation of Alternate Path Openhole Packer Providing True Zonal Isolation in Openhole Gravel Packs*," SPE Conference, SPE Paper No. 146361 (Nov. 2011), pp. 1-10.

Yeh, C. S. et al., "Unlocking the Limits of Extreme Length in Alternate Path Gravel Packing," International Petroleum Technology Conference, IPTC Conference Paper 12549 (Dec. 2008), pp. 1-13.

DOWNHOLE SAND CONTROL ASSEMBLY WITH FLOW CONTROL AND METHOD FOR COMPLETING A WELLBORE

CROSS-REFERENCE TO RELATED APPLICATIONS

This application claims the benefit of U.S. Provisional Patent Application No. 62/203,001, filed Aug. 10, 2015, entitled "Downhole Sand Control Assembly with Flow Control and Method for Completing a Wellbore, the entirety of which is incorporated by reference herein. This application is also related to and claims the benefit of U.S. Provisional Patent Application No. 62/203,000, filed Aug. 10, 2015, entitled, "Hybrid Sand Control Systems and Methods for Completing a Wellbore with Sand Control," the disclosure of which is incorporated by reference in its entirety.

This application is related to PCT/US2014/050547, filed Aug. 11, 2014 and US counterpart thereto, U.S. patent application Ser. No. 14/456,565, filed Aug. 11, 2014, entitled "Downhole Sand Control Assembly with Flow Control and Method for Completing a Wellbore, the disclosure of which is incorporated by reference in its entirety.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of well completions. More specifically, the present invention relates to the isolation of formations in connection with wellbores that have been completed through multiple zones using sand control devices. This application also relates to sand screen assemblies that have both bypass conduits for gravel slurry, and in-flow control devices for controlling the flow of production fluids into a base pipe, thereby providing for both a consistent gravel packing and the control of production fluids along the wellbore.

Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of formations behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place and perforated. In some instances, the final string of casing is a liner, that is, a string of casing that is not tied back to the surface.

As part of the completion process, a wellhead is installed at the surface. The wellhead controls the flow of production fluids to the surface, or the injection of fluids into the wellbore. Fluid gathering and processing equipment such as pipes, valves and separators are also provided. Production operations may then commence.

It is sometimes desirable to leave the bottom portion of a wellbore open. In open-hole completions, a production casing is not extended through the producing zones and perforated; rather, the producing zones are left uncased, or "open." A "slotted base pipe" is then positioned inside the open wellbore extending down below the last string of casing.

There are certain advantages to open-hole completions versus cased-hole completions. First, because open-hole completions typically have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole completion virtually guarantees that it will be more productive than an unstimulated, cased hole in the same formation.

Second, open-hole techniques are oftentimes less expensive than cased hole completions. For example, the use of slotted base pipes eliminates the need for cementing, perforating, and post-perforation clean-up operations. Alternatively, the use of a sand screen, with or without a gravel packs along the open hole wellbore, helps maintain the integrity of the wellbore while allowing substantially 360 degree radial formation exposure.

In connection with the installation of gravel packs, fluid bypass technology has been developed to ensure a uniform installation of "gravel pack" along the length of sand screens. This bypass technology employs shunt tubes, or alternate flow channels, placed along selected lengths of sand screen joints. The tubes allow a gravel slurry to be transported downhole across premature sand bridges and even packers along a wellbore. Such fluid bypass technology is described, for example, in U.S. Pat. No. 5,588,487 entitled "Tool for Blocking Axial Flow in Gravel-Packed Well Annulus," and PCT Publication No. WO2008/060479 entitled "Wellbore Method and Apparatus for Completion, Production, and Injection," each of which is incorporated herein by reference in its entirety.

Additional references which discuss alternate flow channel technology include U.S. Pat. Nos. 7,971,642; 7,938,184; 7,661,476; 8,011,437; 8,186,429; 8,215,406; 8,430,160; and 8,789,612. See also M. T. Hecker, et al., "*Extending Open-hole Gravel-Packing Capability: Initial Field Installation of Internal Shunt Alternate Path Technology*," SPE Annual Technical Conference and Exhibition, SPE Paper No. 135, 102 (September 2010); and M. D. Barry, et al., "*Open-hole Gravel Packing with Zonal Isolation*," SPE Paper No. 110,460 (November 2007). The alternate flow channel technology enables a true zonal isolation in multi-zone, open hole gravel pack completions. The alternate flow channel technology is practiced under the name Alternate Path®, owned by ExxonMobil Corporation of Irving, Tex.

Recently, improvements to the alternate flow channel technology have included the use of inflow control devices placed strategically along sand control assemblies. The inflow control devices serve as restrictive flow paths. The inflow control devices, or "ICD's," beneficially balance the inflow profile of hydrocarbon fluids along a sand control assembly. ICD's further help prevent gas/water breakthrough. Problems associated with water/gas production may include productivity loss, equipment damage, and/or increased treating, handling and disposal costs at the surface. These problems are further compounded for wells that have a number of different completion intervals and where the formation pressure may vary from interval to interval. As such, water or gas breakthrough in any one of the intervals may threaten the remaining reserves within the well.

International Publ. No. WO 2007/126496; U.S. Pat. Nos. 7,708,068; 7,984,760; 8,127,831; and U.S. Patent Publ. No. 2015/0027700 disclose a variety of embodiments for using in-flow control devices, including in connection with sand screens. These include the use of swellable or degradable material and sliding sleeves, which may be actuated or manipulated to block the flow of production fluids into a base pipe once production operations commence. Thus, selective fluid flows along one or more joints of sand screen, particularly during production mode, may be accomplished using in-flow control devices.

It is observed that the use of ICD's as described in International Publ. No. WO 2007/126496 and other disclosures is applicable for both conventional sand screens and Alternate Path® screens. However, additional fluid flow control hardware is needed for modern sand screen arrangements having Internal Shunt Alternate Path® (ISAPT) technology, wherein coupling assemblies for connecting shunt tubes along sand screens are used. These include the sand control devices and connection hardware described in International Publ. No. WO2008/060479 and in U.S. Pat. No. 8,356,664.

Therefore, a need remains for an improved sand control assembly that provides bypass technology during a gravel packing procedure, and which also offers flow control between a base pipe and a surrounding annular region during production operations through the use of in-flow control devices or valves. Additionally, a need exists for a method of completing a wellbore wherein a sand screen assembly is placed along a formation that uses selected or controlled fluid communication between the sand screen and the bore of the base pipe during both gravel packing and production.

SUMMARY OF THE INVENTION

A sand screen assembly is first provided herein. The sand screen assembly is designed to reside and operate within a wellbore. Preferably, the wellbore has been completed horizontally. The assembly has particular utility in connection with the control of fluid flow between an annular region outside of a base pipe, and the internal bore of the base pipe, all residing within a surrounding open-hole portion of the wellbore. The open-hole portion extends through one, two, or more subsurface intervals.

The sand screen assembly first includes an elongated base pipe. The base pipe defines a blank tubular body. The base pipe has a first end, a second end, and a bore there between forming a flow path for production fluids. The bore is configured to be placed in fluid communication with a production tubing.

The sand screen assembly also includes a filter media. The filter media is disposed circumferentially around and resides along at least a portion of the base pipe. The filter media creates an annular flow path for production fluids moving from a surrounding subsurface formation towards an outer diameter of the base pipe during a subsurface production operation. Beneficially, the annular flow path also receives fluid leak-off during a gravel packing operation.

The sand screen assembly further includes a pair of coupling assemblies. These represent a first coupling assembly operatively connected at the first end of the base pipe, and a second coupling assembly operatively connected at the second end of the base pipe. Each coupling assembly comprises a manifold that receives gravel slurry from transport conduits across adjacent sand screen assemblies during a gravel packing operation.

The sand screen assembly next includes one or more transport conduits. The transport conduits reside along the outer diameter of the base pipe in the annular flow path. Each of the transport conduits presents a bore for communicating gravel slurry to the first and second coupling assemblies. Some of the transport conduits are preferably shunt tubes for delivering slurry between selected sand screen joints.

Finally, the sand screen assembly comprises an in-flow control section. The in-flow control section selectively permits fluid leak-off to flow into the bore of the base pipe during a gravel packing operation. The in-flow control section further permits production fluids to flow into the bore of the base pipe during a production operation. The in-flow control section is configured so that a less restrictive flow path is provided into the bore of the base pipe for gravel slurry leak-off during a gravel packing operation, than for production fluids during a later production operation. Additionally, the in-flow control section is configured to restrict the flow path for gravel slurry leak-off after the gravel packing operation is completed. This forces production fluids to controllably flow primarily through production fluid openings in the base pipe.

Preferably, the sand screen assembly includes an impermeable housing. The impermeable housing defines a blank tubular body that resides around the in-flow control section.

In one aspect, the in-flow control section is further configured to selectively shut off the flow path for production fluids after production operations have commenced. In another embodiment, the in-flow control section comprises production openings that are tuned to restrict the flow of production fluids into the bore of the base pipe after production operations have commenced. The production openings may be, for example, in the base pipe itself, and form a pre-defined cross-sectional area for fluid flow.

In one embodiment, the in-flow control-section comprises at least one gravel packing opening in the base pipe. The gravel packing opening allows fluid communication for gravel slurry leak-off between the annular flow path and the bore of the base pipe during gravel packing. The in-flow control section also includes one or more in-flow control devices for controlling the flow of production fluids from the annular flow path of a section of filter media into the bore of the first base pipe. In addition, the in-flow control section includes a cylindrical transition ring. The transition ring is disposed adjacent a coupling assembly along the base pipe, and has (i) a body defining an inner diameter that sealingly receives the base pipe, and an outer diameter, (ii) openings around the body of the transition ring for transporting gravel slurry across adjacent sections of the filter media, and (iii) one or more fluid-flow conduits along the body for transporting wellbore fluids from the annular flow path around the base pipe to the in-flow control device.

In one aspect, the sand screen assembly further comprises at least one cylindrical nozzle ring. The nozzle rings are disposed along the base pipe intermediate sections of the filter media between the first end and the second end. Each nozzle ring has (i) a body defining an inner diameter that sealingly receives the base pipe, and an outer diameter, (ii) openings around the body of the nozzle ring for transporting gravel slurry across adjacent sections of the filter media, and (iii) one or more fluid-flow conduits along the body of the nozzle ring for transporting wellbore fluids to production fluid openings in the base pipe.

In one aspect, each coupling assembly comprises a load sleeve and a torque sleeve. The load sleeve is mechanically connected proximate the first end of the base pipe, while the torque sleeve is mechanically connected proximate the second end of a base pipe in an adjoining sand screen assembly. The load sleeve and the torque sleeve, in turn, are connected by means of an intermediate coupling joint. Preferably, the load sleeve and the torque sleeve are bolted into the respective base pipes to prevent relative rotational movement.

Each of the load sleeve and the torque sleeve comprises a cylindrical body. The sleeves each have an outer diameter, a first and second end, and a bore extending from the first end to the second end. The bore forms an inner diameter in each of the cylindrical bodies. Each of the load sleeve and the torque sleeve also includes at least one transport channel, with each of the transport channels extending along the respective sleeve from the first end to the second end.

The intermediate coupling joint also comprises a cylindrical body that defines a bore therein. The bore is in fluid communication with the base pipes of the sand screen joints. A co-axial sleeve is placed concentrically within the coupling joint, forming an annual region between an inner diameter and an outer diameter. The annular region defines a manifold region, with the manifold region placing the transport conduits of the load sleeve and the torque sleeve in fluid communication.

The load sleeve, the torque sleeve and the intermediate coupling joint form a coupling assembly that operatively connects adjoining sand screen assemblies. The coupling joint has opposing female threads for connecting the base pipes of adjoining sand screen assemblies along an open-hole portion of the wellbore. In one aspect, each of the load sleeve and the torque sleeve presents shoulders that receive the opposing ends of the coupling joint. O-rings may be used along the shoulders to preserve a fluid seal.

A method for completing a wellbore in a subsurface formation is also provided herein. The wellbore preferably includes a lower portion completed horizontally.

In one aspect, the method includes providing a first sand screen assembly. The first sand screen assembly is constructed in accordance with the sand screen assembly described above, in its various embodiments. For example, the sand screen assembly includes a base pipe that forms a flow path for production fluids, and a filter media disposed circumferentially around and residing along a portion of the base pipe. The filter media creates an annular flow path for production fluids moving from a surrounding subsurface formation towards an outer diameter of the base pipe during a subsurface production operation.

The method also includes running the first sand screen assembly into a wellbore, and then conducting a gravel packing operation Fluid leak-off occurs as sand is packed around the sand screen assembly during the gravel packing operation.

In one embodiment, the in-flow control-section of the first sand screen assembly comprises at least one gravel packing opening in the base pipe. The gravel packing opening allows fluid communication for gravel slurry leak-off between the annular flow path and the bore of the base pipe during gravel packing. The method further includes shutting off the flow path for gravel slurry leak-off in the in-flow control section. This is done after the gravel packing operation is completed.

In one aspect, the method further includes producing hydrocarbon fluids through the base pipe of the first sand screen assembly (and through the base pipes of adjoining sand screen assemblies) along the wellbore. Producing hydrocarbon fluids causes hydrocarbon fluids to travel from the annular flow path, through the in-flow control section, into the base pipes, and to the surface.

During production, hydrocarbon fluids flow into one or more production fluid openings formed in the base pipe within the in-flow control section. The method then further comprises actuating a sleeve in order to increase or decrease the flow of production fluids through the at least one production opening and into the bore of the first base pipe. In another embodiment, the in-flow control section comprises production openings that are pre-tuned to restrict the flow of production fluids into the bore of the base pipe after production operations have commenced.

In one aspect, the method includes shutting off the flow path for production fluids in the in-flow control section after the first period of time. Shutting off the flow path for production fluids in the in-flow control section may comprise, for example, actuating a sleeve or actuating a swellable material to close off flow into the base pipe completely. In one aspect, the production fluid opening comprises an autonomous ICD valve that senses fluid composition, and then closes upon sensing water or gas break through.

Preferably, the method also includes operatively connecting the first end of the first sand screen assembly to the second end of a second sand screen assembly, and operatively connecting the second end of the first sand screen assembly to the first end of a third sand screen assembly. This is done by means of the opposing coupling assemblies. In one embodiment, the coupling assembly includes a load sleeve, a torque sleeve, and an intermediate coupling joint. Multiple sand screen assemblies each having one or more sand screen joints and a plurality of nozzle rings may be joined end-to-end.

Optionally, the method further includes providing a packer assembly. The packer assembly includes at least one, and preferably two, mechanically-set packers. Alternatively or in addition, the packer assembly also includes at least one swellable sealing element. The packer assemblies may optionally be actuated to isolate zones along the wellbore.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

In FIG. 8A, slots are used as the ICD; in FIG. 8B, a conduit is used as the ICD.

In FIG. 8C, a rotating sleeve is used as the ICD; in FIG. 8D, a sliding sleeve is used as the ICD.

DETAILED DESCRIPTION OF CERTAIN EMBODIMENTS

Definitions

Figure 1A:
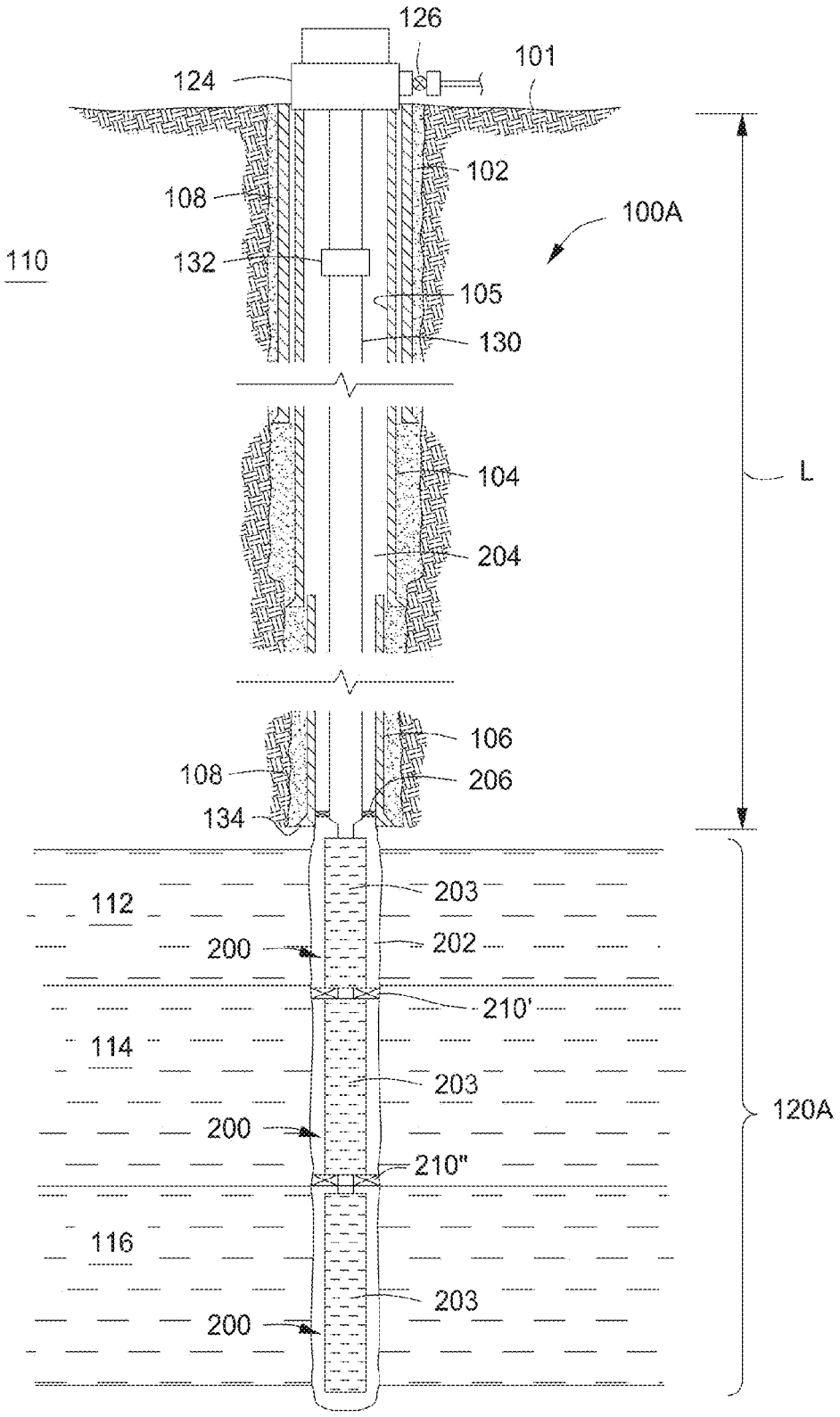
FIG. 1A is a cross-sectional view of a first illustrative wellbore. The wellbore has been drilled vertically through three different subsurface intervals, each interval being under formation pressure and containing fluids.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. to 20° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "production fluids" refers to those fluids, including hydrocarbon fluids, which may be received from a subsurface formation into a wellbore.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof. A subsurface interval may have more than one zone of interest.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

DESCRIPTION OF SPECIFIC EMBODIMENTS

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined and or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

FIG. 1A is a cross-sectional view of an illustrative wellbore 100A. The wellbore 100A defines a bore 105 that extends from a surface 101, and into the earth's subsurface 110. The wellbore 100A is completed to have an open-hole portion 120A at a lower end of the wellbore 100. The wellbore 100A has been formed for the purpose of producing hydrocarbons for processing or commercial sale. A string of production tubing 130 is provided in the bore 105 to transport production fluids from the open-hole portion 120A up to the surface 101.

The wellbore 100A includes a well tree, shown schematically at 124. The well tree 124 includes a shut-in valve 126. The shut-in valve 126 controls the flow of production fluids from the wellbore 100. In addition, a subsurface safety valve 132 is provided to block the flow of fluids from the production tubing 130 in the event of a rupture or catastrophic event above the subsurface safety valve 132. The wellbore 100A may optionally have a pump (not shown) within or just above the open-hole portion 120A to artificially lift production fluids from the open-hole portion 120A up to the well tree 124.

The wellbore 100A has been completed by setting a series of pipes into the subsurface 110. These pipes include a first string of casing 102, sometimes known as surface casing or a conductor. These pipes also include at least a second 104 and a third 106 string of casing. These casing strings 104, 106 are intermediate casing strings that provide support for walls of the wellbore 100A. Intermediate casing strings 104, 106 may be hung from the surface, or they may be hung from a next higher casing string using an expandable liner or liner hanger. It is understood that a pipe string that does not extend back to the surface (such as casing string 106) is normally referred to as a "liner."

In the illustrative wellbore arrangement of FIG. 1A, intermediate casing string 104 is hung from the surface 101, while casing string 106 is hung from a lower end of casing string 104. Additional intermediate casing strings (not shown) may be employed. The present inventions are not limited to the type of casing arrangement used.

Each string of casing 102, 104, 106 is set in place through a cement column 108. The cement column 108 isolates the various formations of the subsurface 110 from the wellbore 100A and each other. The column of cement 108 extends from the surface 101 to a depth "L" at a lower end of the casing string 106. It is understood that some intermediate casing strings may not be fully cemented.

An annular region 204 (seen in FIG. 2) is formed between the production tubing 130 and the casing strings 102, 104, 106. A production packer 206 seals the annular region 204 near the lower end "L" of the casing string 106.

In many wellbores, a final casing string known as production casing is cemented into place at a depth where subsurface production intervals reside. However, the illustrative wellbore 100A is completed as an open-hole wellbore. Accordingly, the wellbore 100A does not include a final casing string along the open-hole portion 120A.

In the illustrative wellbore 100A, the open-hole portion 120A traverses three different subsurface intervals. These are indicated as upper interval 112, intermediate interval 114, and lower interval 116. Upper interval 112 and lower interval 116 may, for example, contain valuable oil deposits sought to be produced, while intermediate interval 114 may contain primarily water or other aqueous fluid within its pore volume. This may be due to the presence of native water zones, high permeability streaks or natural fractures in the aquifer, or fingering from injection wells. In this instance, there is a probability that water will invade the wellbore 100A.

Alternatively, upper 112 and intermediate 114 intervals may contain hydrocarbon fluids sought to be produced, processed and sold, while lower interval 116 may contain some oil along with ever-increasing amounts of water. This may be due to coning, which is a rise of near-well hydrocarbon-water contact. In this instance, there is again the possibility that water will invade the wellbore 100A.

Alternatively still, upper 112 and lower 116 intervals may be producing hydrocarbon fluids from a sand or other permeable rock matrix, while intermediate interval 114 may represent a non-permeable shale or otherwise be substantially impermeable to fluids.

In any of these events, it is desirable for the operator to isolate selected intervals. In the first instance, the operator will want to isolate the intermediate interval 114 from the production string 130 and from the upper 112 and lower 116 intervals (by use of packer assemblies 210' and 210") so that primarily hydrocarbon fluids may be produced through the wellbore 100 and to the surface 101. In the second instance, the operator will eventually want to isolate the lower interval 116 from the production string 130 and the upper 112 and intermediate 114 intervals so that primarily hydrocarbon fluids may be produced through the wellbore 100A and to the surface 101. In the third instance, the operator will want to isolate the upper interval 112 from the lower interval 116, but need not isolate the intermediate interval 114.

In the illustrative wellbore 100A of FIG. 1A, a series of sand screens 200 extends through the intervals 112, 114, 116. The sand screens 200 and connected packer assemblies 210', 210" are shown more fully in FIG. 2.

It is observed that the wellbore 100A of FIG. 1A is completed vertically. However, the majority of wells now being drilled in North America are being completed horizontally.

Figure 1B:
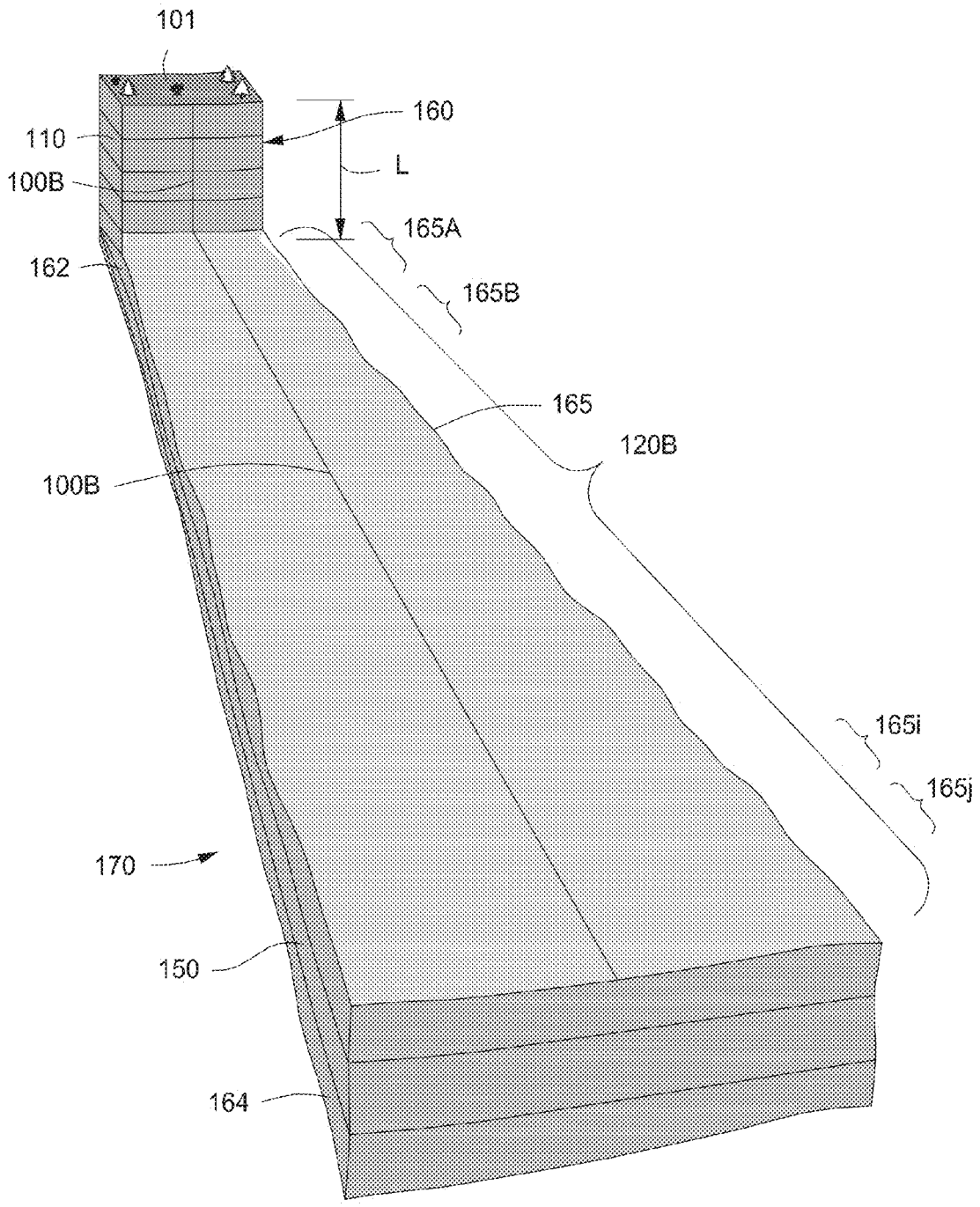
FIG. 1B is a perspective, cut-away view of a second illustrative wellbore. Here, the wellbore has been drilled horizontally along a formation, and is being completed with multiple sand screen assemblies.

FIG. 1B is a perspective, cut-away view of a wellbore 100B that has been drilled horizontally. The wellbore 100B includes a vertical portion 160 that extends from the surface 101, and a horizontal section 170 that extends along a subsurface formation 150. The illustrative horizontal section represents an open-hole section 120B.

The horizontal portion 160 has a heel 162 and a toe 164. Along the horizontal section 160 the wellbore 100B has a series of zones 165. The zones are indicated as 165*a*, 165*b*, . . . 165*i*, 165*j*. Each zone 165 may have its own fluid flow and reservoir characteristics such as pressure, lithology and fluid composition. Thus, the sand screen and packer arrangement of FIG. 1A may be applied to the wellbore 100B of FIG. 1B to isolate selected zones.

Figure 2:
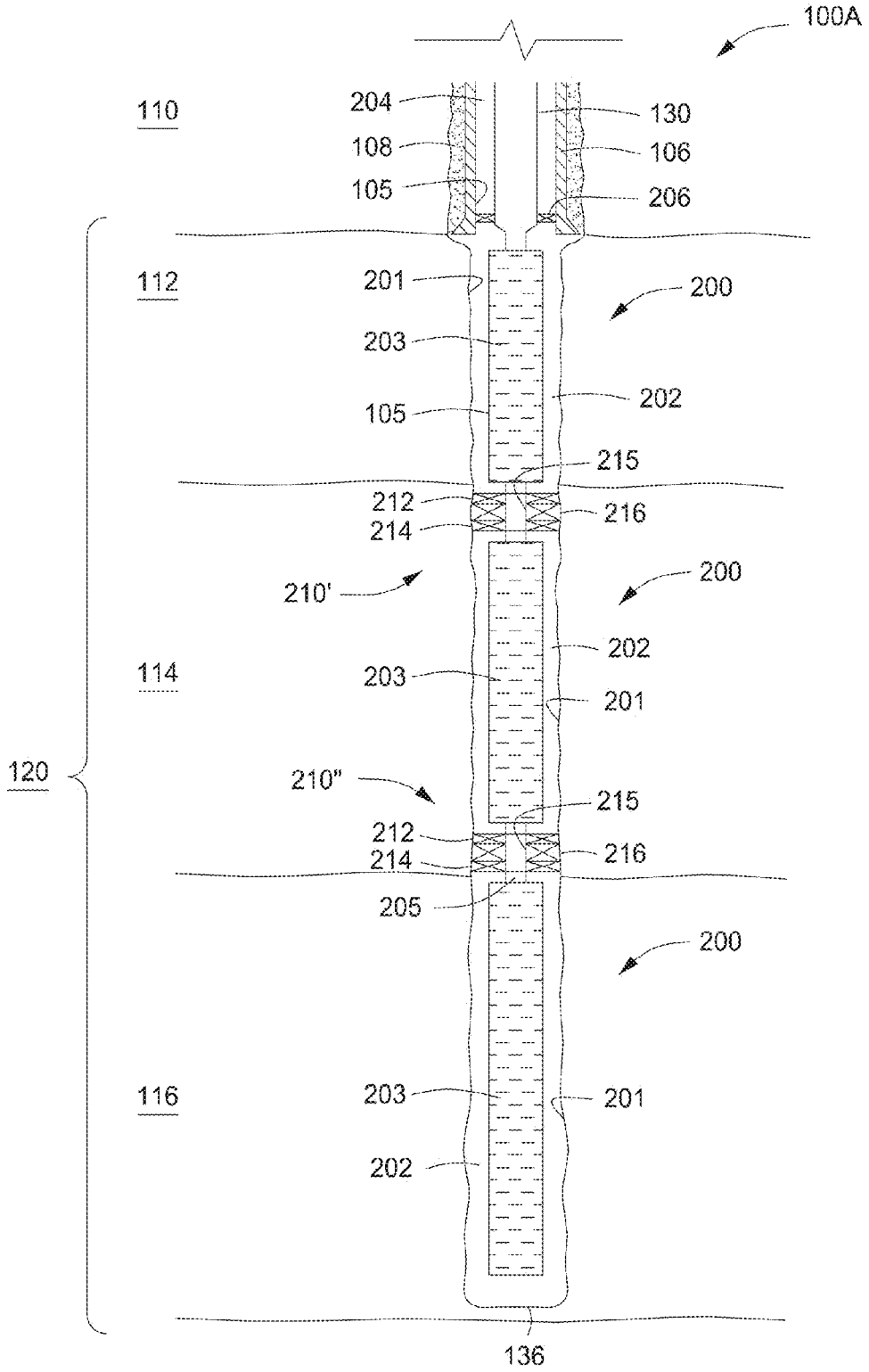
FIG. 2 is an enlarged cross-sectional view of an open-hole completion of the wellbore of FIG. 1A. The open-hole completion at the depth of the three illustrative intervals is more clearly seen.

Referring now to FIG. 2, an enlarged view of a series of sand screen assemblies is shown. The sand screens 200 define an elongated tubular body 205. Each tubular body 205 is made up of a plurality of one or more base pipes threadedly connected end-to-end. The base pipes 205 are tubular bodies, with perforations or slots placed at a strategic location. In addition, the sand screens 200 include a surrounding filter medium wound there around to form sand screens. The filter medium may be a metal wire or ceramic wrap fitted around the base pipe 205. The filter medium has parallel slots that prevent the inflow of sand or other particles above a pre-determined size into the base pipe 205 and the production tubing 130. As part of the filter media, an additional layer of woven mesh and/or shaped memory polymer material may be provided around the wire wrap.

In addition to the sand screens 200, the wellbore 100 includes one or more packer assemblies 210. In the illustrative arrangement of FIGS. 1A and 2, the wellbore 100A has an upper packer assembly 210' and a lower packer assembly 210". However, additional packer assemblies 210 or just one packer assembly 210 may be used. The packer assemblies 210', 210" are uniquely configured to seal an annular region (seen at 202 of FIG. 2) between the various sand screens 200 and a surrounding wall 201 of the open-hole portion 120A of the wellbore 100A.

FIG. 2 provides an enlarged cross-sectional view of the open-hole portion 120A of the wellbore 100A of FIG. 1A. The open-hole portion 120A and the three intervals 112, 114, 116 are more clearly seen. The upper 210' and lower 210" packer assemblies are also more clearly visible proximate upper and lower boundaries of the intermediate interval 114, respectively.

Concerning the packer assemblies themselves, each packer assembly 210', 210" may have two separate packers. In a swellable packer assembly, the packers are set chemically by fluid contact. In a mechanically-set packer assembly, the packers are set through a combination of mechanical manipulation and hydraulic forces. For illustrative purposes of this disclosure, the packers are referred to as being mechanically-set packers. The illustrative packer assemblies 210 represent an upper packer 212 and a lower packer 214. Each packer 212, 214 has an expandable portion or element fabricated from an elastomeric or a thermoplastic material capable of providing at least a temporary fluid seal against a surrounding wellbore wall 201.

Details concerning setting and operation of packer assemblies in conjunction with gravel packing are disclosed in PCT Patent Appl. No. WO2012/082303 entitled "Packer for Alternate Flow Channel Gravel Packing and Method for Completing a Wellbore." This publication describes a packer that may be mechanically set within an open-hole wellbore. This PCT application, published Jun. 21, 2102, is referred to and incorporated in its entirety herein by reference.

FIG. 2 shows a mandrel at 215 in the packers 212, 214. This may be representative of the piston mandrel, and other mandrels used in the packers 212, 214 as described more fully in the WO2012/082303 PCT application. The mandrels form part of a primary flow path for production fluids.

As a "back-up" to the expandable packer elements within the upper 212 and lower 214 packers, the packer assemblies 210', 210" may also include an intermediate packer element 216. The intermediate packer element 216 defines a swelling elastomeric material fabricated from synthetic rubber compounds. Suitable examples of swellable materials may be found in Easy Well Solutions' Constrictor™ or Swell-Packer™, and SwellFix's EZIP™. The swellable packer 216 may include a swellable polymer or swellable polymer material, which is known by those skilled in the art and which may be set by one of a conditioned drilling fluid, a completion fluid, a production fluid, an injection fluid, a stimulation fluid, or any combination thereof.

It is noted that a swellable packer 216 may be used alone or in lieu of the upper 212 and lower 214 packers. The present inventions are not limited by the presence or design of any packer assembly unless expressly so stated in the claims.

The upper 212 and lower 214 packers may generally be mirror images of each other, except for the release sleeves that shear respective shear pins or other engagement mechanisms. Unilateral movement of a setting tool (not shown) will allow the packers 212, 214 to be activated in sequence or simultaneously. The lower packer 214 is activated first, followed by the upper packer 212 as a mechanical shifting tool is pulled upward through an inner mandrel.

The packer assemblies 210', 210" help control and manage fluids produced from different zones. In this respect, the packer assemblies 210', 210" allow the operator to seal off an interval from either production or injection, depending on well function. Installation of the packer assemblies 210', 210" in the initial completion allows an operator to shut-off the production from one or more zones during the well lifetime to limit the production of water or, in some instances, an undesirable non-condensable fluid such as hydrogen sulfide.

It is necessary to connect the packer assemblies 210', 210" to the sand screen assemblies 200. It is further necessary to threadedly connect the sand screen joints of the assemblies 200 together in series to form a series of sand screen assemblies. These operations may be done using a unique coupling assembly (shown at 301 in FIGS. 3A and 4A) that employs a load sleeve (shown at 303 in FIGS. 3A and 5A), a torque sleeve (shown at 305 in FIGS. 3A and 6), and an intermediate coupling joint (shown at 301 in FIG. 4B). These features are seen in operation together in FIG. 3A.

Figure 3A:
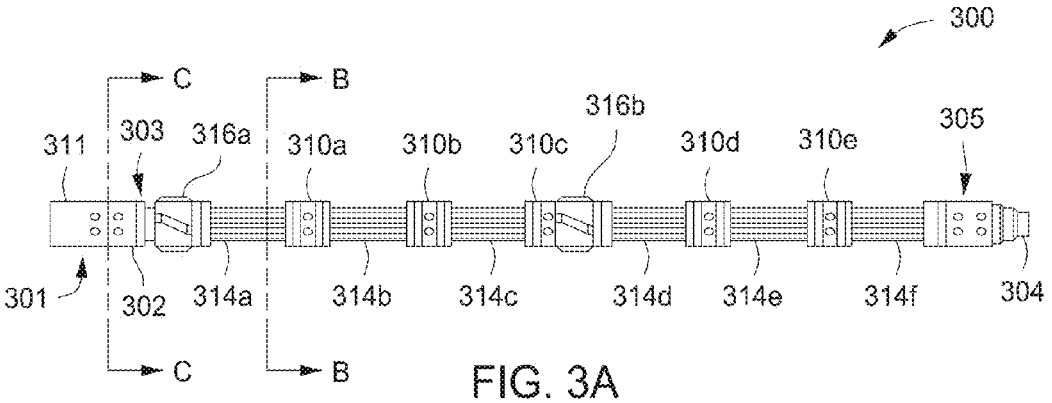
FIG. 3A (Prior Art)
FIG. 3A presents a side view of a sand screen assembly of the present invention, in one embodiment. The assembly includes a load sleeve, a torque sleeve and an intermediate sand screen. The assembly is shown with shunt tubes along its length.

FIG. 3A offers a side view of a sand screen assembly 300 as may be used in the wellbore completion methods of the present invention, in one embodiment. The sand screen assembly 300 is intended to represent one or more joints of sand screen having an extended base pipe (seen at 320 in FIG. 3B) surrounded by a filter media 330. The base pipe 320 is preferably a series of blank pipe joints. The base pipe 320 defines a tubular body having a bore 315 therein. Each pipe joint may be between 10 feet (3.05 meters) and 40 feet (12.19 meters). The bore 315 within the base pipe 320 joints serves as a primary flow path for production fluids.

As discussed further below, the base pipe 320 includes perforations or slots, wherein the perforations or slots are grouped together along a portion of the base pipe 320 to provide for routing of fluid. The slots serve as production fluid openings and reside within an in-flow control section of the sand screen assembly 300. Various arrangements for an in-flow control section are described below.

The base pipe 320 preferably extends the axial length of the sand screen assembly 300. The base pipe 320 is operably attached to a load sleeve 303 near an upstream or first end, and to a torque sleeve 305 at a downstream or second end.

Along the base pipe 320, a filter medium 330 is seen. The filter medium 330 represents a wire wrapped sand screen or other device that filters particles of a pre-determined size. As used herein, the term "sand screen" refers to any filtering mechanism configured to prevent the passage of particulate matter having a certain size, while permitting flow of gases, liquids and small particles. The size of the filter will generally be in the range of 60-120 mesh, but may be larger or smaller depending on the specific environment. Many sand screen types are known in the art and include wire-wrap, mesh material, woven mesh, and sintered metal. The filtering medium may be metal or ceramic. In any embodiment, the filter medium 330 creates a matrix that permits an ingress of formation fluids while restricting the passage of sand particles over a certain gauge.

The sand screen assembly 300 further includes at least one nozzle ring 310 positioned along its length. In the arrangement of FIG. 3A, multiple nozzle rings are shown in series at 310*a*, 310*b*, . . . 310*e*. The nozzle rings 310 support shunt tubes 308 disposed longitudinally along the base pipe 320.

The sand screen assembly 300 further includes at least one sand screen segment 314. In the arrangement of FIG. 3A, sand screen segments (or joints) are shown in series at 314*a*, 314*b*, . . . 314*f*. Preferably, sand screen segments 314 are disposed between one of the plurality of nozzle rings 310 and the torque sleeve assembly 305, between two of the plurality of nozzle rings 310, and between the load sleeve assembly 303 and one of the plurality of nozzle rings 310.

The assembly 300 may further include at least one centralizer 316. Here, centralizers are shown at 316*a* and 316*b*. The centralizers 316 may be placed around at least a portion of a load sleeve assembly 303 or one of the plurality of nozzle rings 310.

Figure 3B:
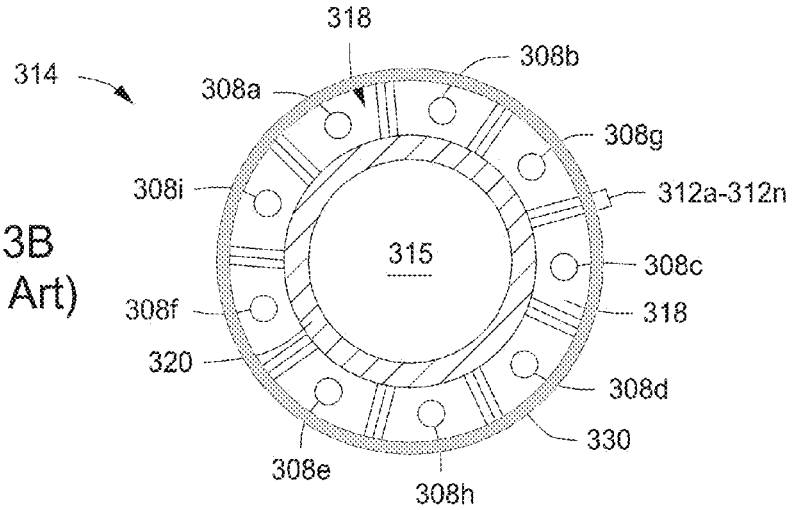
FIG. 3B (Prior Art)
FIG. 3B is a cross-sectional view of the sand screen assembly of FIG. 3A. The section is taken across line B-B of FIG. 3A, and shows features of the sand screen including a plurality of radially disposed shunt tubes.

FIG. 3B is a cross-sectional view of the sand screen assembly 300 of FIG. 3A, taken across line B-B of FIG. 3A. Specifically, the view is taken through the base pipe 320 along a filtering conduit 330. It is seen that the filter medium 330 resides generally concentrically about the base pipe 320. Production fluids such as hydrocarbon fluids travel through the filter medium 330 and into an annular region 318 around the base pipe 320.

Shunt tubes 308 are also seen residing around the base pipe 320. The shunt tubes 308 reside in the annular region 318. The shunt tubes 308 are used for the distribution of sand slurry during a gravel packing operation. Preferably, the sand screen assembly 300 uses four to six packing tubes 308*a*, 308*b*, . . . 308*n* for transporting gravel slurry across sections of sand screen 314 as part of an alternate flow, or "bypass" system, in connection with a gravel packing procedure. Preferably, the sand screen assembly 300 also uses three gravel tubes 308*g*, 308*h*, 308*i* that deliver sand slurry to a specific location along the sand screen 314.

In the arrangement of FIG. 3B, nine shunt tubes 308 are shown, indicated at 308*a*, 308*b*, . . . 308*h*. The configuration of the shunt tubes 308 may be either concentric or eccentric, though only a concentric arrangement is shown here.

Referring back to FIG. 3A, the sand screen assembly 300 has a first or upstream end 302 and a second downstream end 304. A load sleeve 303 is operably attached at or near the first end 302, while a torque sleeve 305 is operably attached at or near the second end 304. The sleeves 303, 305 are preferably manufactured from a material having sufficient strength to withstand the contact forces achieved during running operations. One preferred material is a high yield alloy material such as S165M.

Figure 3C:
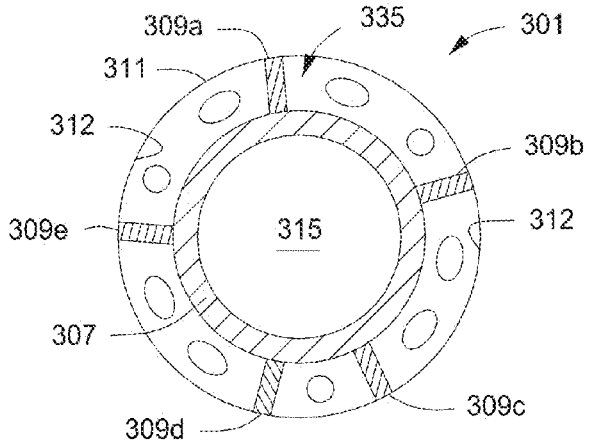
FIG. 3C (Prior Art)
FIG. 3C is another cross-sectional view of the sand screen assembly of FIG. 3A. The section is taken line C-C of FIG. 3A, and shows features of a coupling joint used for connecting adjoining sand screen assemblies.

In practice, sand screen assemblies 300 may be joined end-to-end using a coupling joint 301. FIG. 3C is another cross-sectional view of the sand screen assembly 300 of FIG. 3A. The section is taken line C-C of FIG. 3A, and shows features of a coupling joint 301 used for connecting adjoining assemblies 300.

The coupling joint 301 provides a means for threadedly connecting a load sleeve 302 at one end and a torque sleeve 305 at an opposite end. The coupling joint 301 provides a main bore 315 that is part of the flow path for fluids along the sand screen assembly 300. The coupling joint 301 also includes a co-axial sleeve 311. Interior to the coupling joint 311 is a main body, referred to as the coupling 307. The coupling joint 307 also has at least one torque spacer 309. In the arrangement of FIG. 3C five torque spacers 309*a*-309*e* are shown. The torque spacers 309 support an annular region, or manifold 335, between the coupling 307 and the surrounding co-axial sleeve 311. Stated another way, the torque spacers 309 provide structural integrity to the co-axial sleeve 311 to provide a substantially concentric alignment with the main body 307.

Figure 4A:
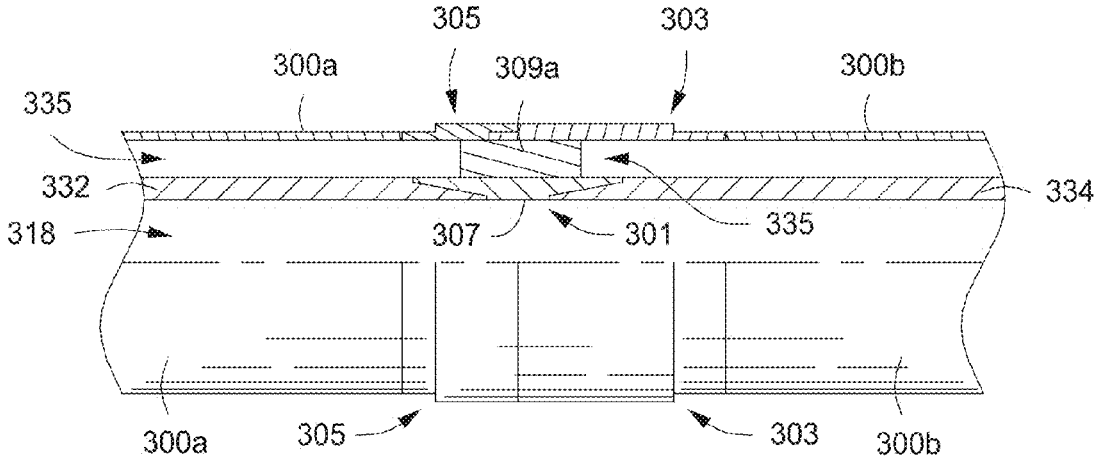
FIG. 4A (Prior Art)
FIG. 4A presents a side, cut-away view of an exemplary coupling assembly utilized with the sand screen assembly of FIG. 3A. The coupling assembly includes a coupling joint that is connected to a load sleeve and a torque sleeve on opposing ends.

FIG. 4A is a cut-away view of an exemplary embodiment of a coupling assembly 301 utilized with the sand screen assembly 300 of FIG. 3A. In the exemplary embodiment, the coupling assembly 301 includes opposing joints of sand screen (or other tubular body, such as a blank housing) 300*a*, 300*b*. The coupling 307 and one torque spacer 309*a* are visible. The at least one torque spacer 309 provides structural integrity to the coupling assembly 301.

The coupling 307 forms a pipe for the primary flow path 315. A secondary flow path is provided in the annular area 335 around the coupling 307. The primary flow path 315 of the coupling joint 301 is aligned with and in and fluid communication with the inner bore 315 of the sand screen joint 314 shown in FIG. 3B. Similarly, the secondary flow path 335 is in fluid communication with the shunt tubes 308 of FIG. 3B around the outer diameter of the base pipes 320. Note that the inner diameter of the manifold region 335 is defined by the outer diameter of the coupling 307, while the outer diameter of the manifold region 335 may be defined by the well tools 300*a*, 300*b* or by a sleeve 303, 305 in substantially concentric alignment with the coupling 307.

Figure 4B:
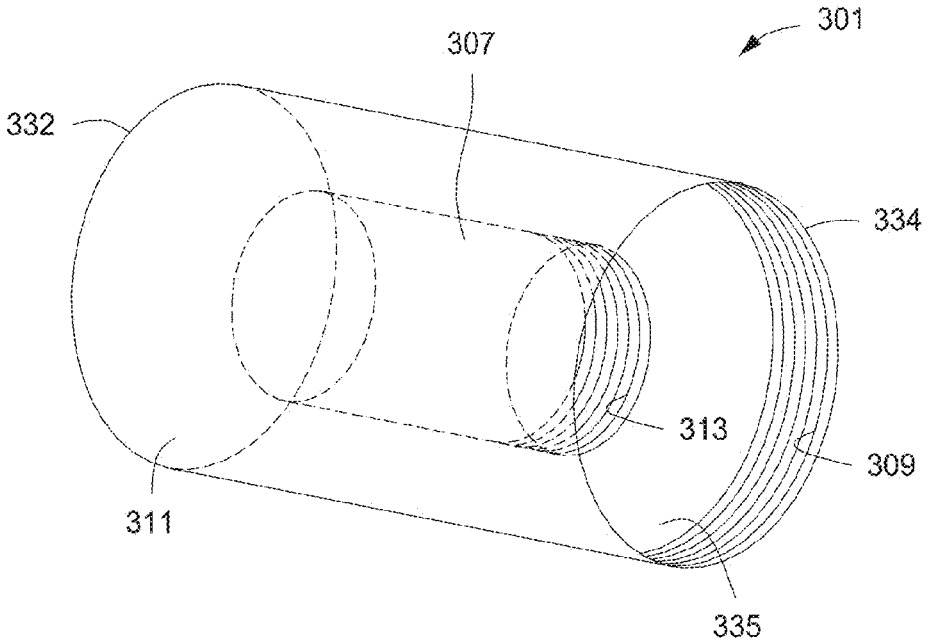
FIG. 4B (Prior Art)
FIG. 4B is a perspective view of the coupling joint from FIG. 4A, in one embodiment. Here, the coupling joint is shown in isolation, that is, without being connected to a load sleeve and a torque sleeve.

FIG. 4B is a perspective view of the coupling joint 301 from FIG. 4A, in one embodiment. Here, the coupling joint 301 is shown in isolation, that is, without being connected to a load sleeve 303 or a torque sleeve 305. The coupling joint 301 has a first or upstream end 332, and a second or downstream end 334. The first end 332 contains female threads (not shown) that threadedly connect to male threads of the torque sleeve 305. Similarly, the second end 334 contains female threads 313 that threadedly connect to male threads of the load sleeve 303. Alternatively, these thread type seals can be replaced by rubber seals, e.g., "O-ring" seals.

The coupling joint 301 is a generally cylindrical body having an outer wall 312. In a preferred arrangement, the outer wall 312 defines the co-axial sleeve. Opposing ends of the co-axial sleeve 311 have respective shoulders that land on the load sleeve 303 and the torque sleeve 305. Thus, the load sleeve 303 and the torque sleeve 305 are connected by means of the intermediate coupling joint 301.

Additional details concerning the use of the coupling joint 301, torque spacers 309 and manifold 335 are provided in WO 2008/060479. Other features such as sealing rings are also discussed and need not be repeated herein.

Figure 5A:
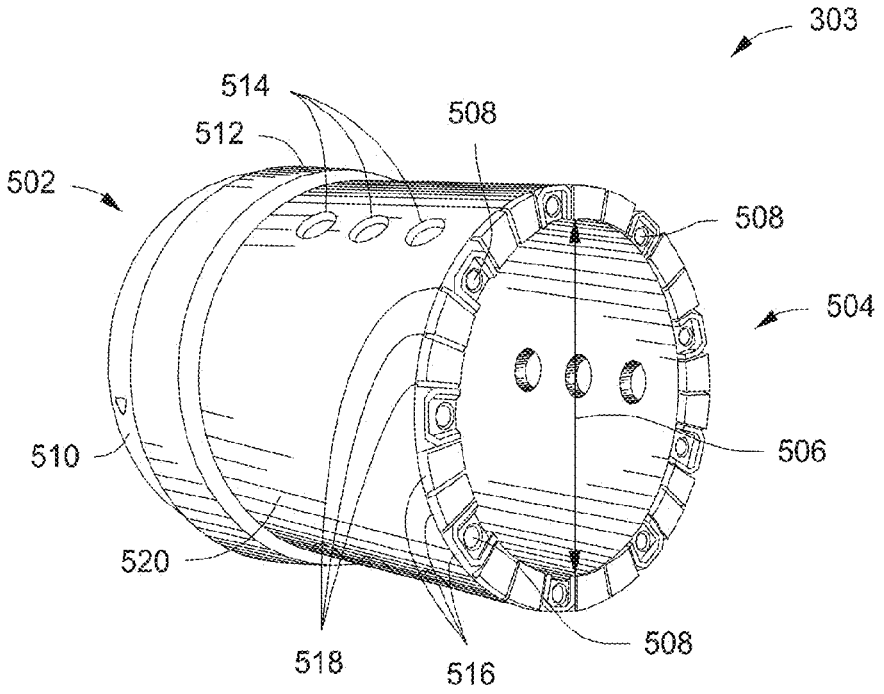
FIG. 5A (Prior Art)
FIG. 5A is an isometric view of a load sleeve as utilized as part of the sand screen assembly of FIG. 3A, in one embodiment.
Figure 5B:
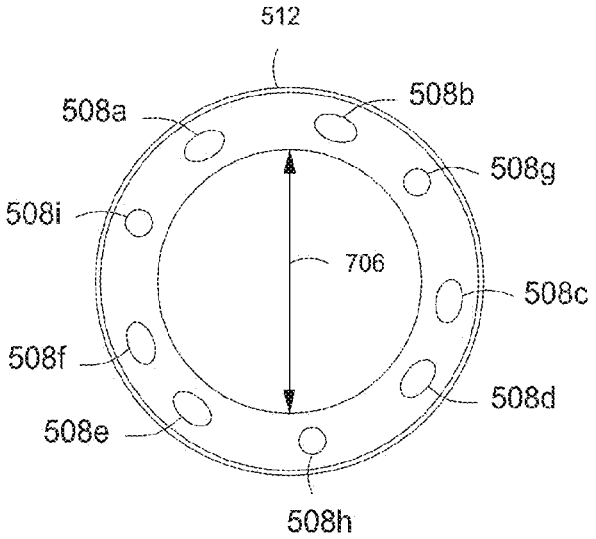
FIG. 5B is an end view of the load sleeve of FIG. 5A.

FIG. 5A is an isometric view of a load sleeve 303 as utilized as part of the sand screen assembly 300 of FIG. 3A, in one embodiment. FIG. 5B is an end view of the load sleeve 303 of FIG. 5A. As can be seen, the load sleeve 303 comprises an elongated body 520 of substantially cylindrical shape. The load sleeve 303 has an outer diameter and a bore extending from a first upstream end 502 to a second downstream end 504. The load sleeve 303 has a diameter 506 that forms a flow path for production fluids en route to the surface 101.

The load sleeve 303 includes at least two transport channels 508. The transport channels 508 are disposed within the body 520 of the sleeve 303. The transport channels 508 are in fluid communication with the transport conduits 308 of FIG. 3B and manifold region 335. As seen in FIG. 5B, the transport channels may represent transport conduits 508*a*-508*f* and at least one packing conduit 508*g*-508*i*.

In some embodiments of the present techniques, the load sleeve 303 includes beveled edges 516 at the downstream end 504 for easier welding of the transport conduits 508 thereto. The preferred embodiment also incorporates a plurality of radial slots or grooves 518 in the face of the downstream or second end 504.

Preferably, the load sleeve 303 includes radial holes 514 between its downstream end 504 and a load shoulder 512. The radial holes 514 are dimensioned to receive threaded connectors, or bolts (not shown). The connectors provide a fixed orientation between the load sleeve 303 and the base pipe 320. For example, there may be nine holes 514 in three groups of three spaced substantially equally around the outer circumference of the load sleeve 303 to provide the most even distribution of weight transfer from the load sleeve 303 to the base pipe 320.

In some embodiments, the transport and packing conduits 508*a*-508*i* are adapted at the second end 502 of the load sleeve assembly 303 to be operably attached, preferably welded, to shunt tubes 308*a*-308*i*. The shunt tubes 308*a*-308*i* may be welded by any method known in the art, including direct welding or welding through a bushing. The shunt tubes 308*a*-308*i* preferably have a round cross-section and are positioned around the base pipe 320 at substantially equal intervals to establish a concentric cross-section.

Figure 6:
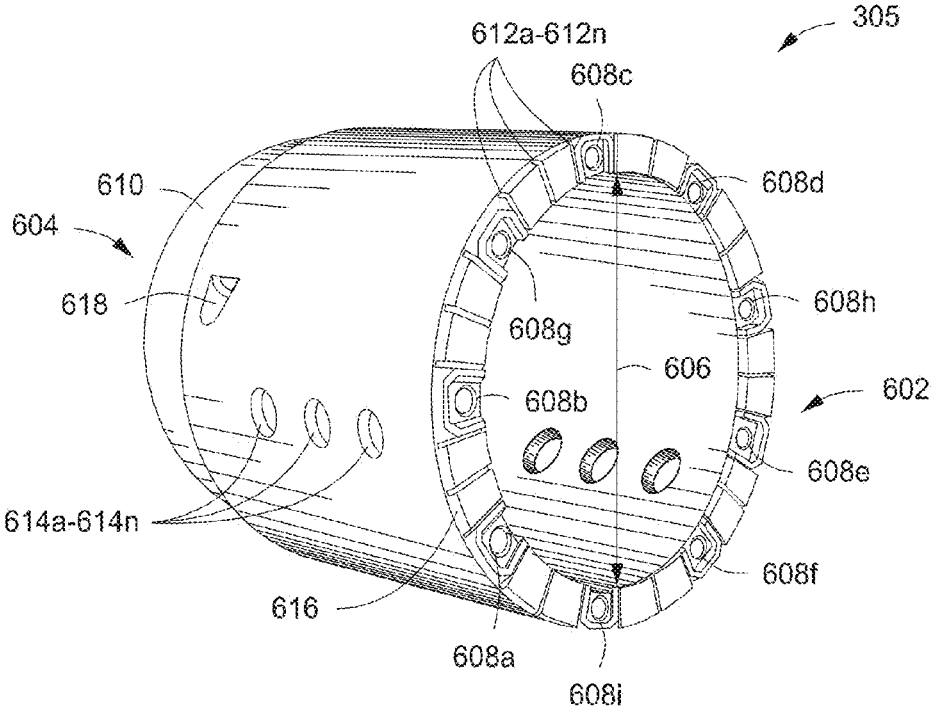
FIG. 6 (Prior Art)
FIG. 6 is a perspective view of a torque sleeve as utilized as part of the sand screen assembly of FIG. 3A, in one embodiment.

Referring next to FIG. 6, FIG. 6 is a perspective view of a torque sleeve 305 utilized as part of the sand screen assembly 300 of FIG. 3A, in one embodiment. The torque sleeve 305 is positioned at the downstream or second end 304 of the illustrative assembly 300.

The torque sleeve 305 includes an upstream or first end 602 and a downstream or second end 604. The torque sleeve 305 also has an inner diameter 606. The torque sleeve 305 further has various alternate path channels, or transport conduits 608. The transport conduits 608 extend from the first end 602 to the second end 604. The transport conduits 608 are also in fluid communication with the shunt tubes 308 of FIG. 3B.

Preferably, the torque sleeve 305 includes radial holes 614 between the upstream end 602 and a shoulder 610 to accept threaded connectors, or bolts, therein. The connectors provide a fixed orientation between the torque sleeve 305 and the base pipe 320. For example, there may be nine holes 614 in three groups of three, spaced equally around the outer circumference of the torque sleeve 305. In the embodiment of FIG. 6, the torque sleeve 305 has beveled edges 616 at the upstream end 602 for easier attachment of the transport conduits 608 thereto.

The load sleeve 303 and the torque sleeve 305 enable immediate connections with packer assemblies or other elongated downhole tools while aligning transport conduits 508-308-608. The load sleeve 303 and the torque sleeve 305 are mechanically connected through the intermediate threaded coupling joint 301. The load sleeve 303, the torque sleeve 305 and the intermediate coupling joint 301 enable sand slurry to flow through a main bore 315 of the base pipes 310 of the sand screen joints 314 and connecting coupling assemblies 301. Thus, a primary flow path is provided through the bore of the base pipes 310, the bore of the load sleeve 303, the bore of the main body 307, and the bore of the torque sleeve 305. At the same time, the transport conduits provide a secondary flow path to bypass any premature sand bridges. The secondary flow path represents a flow path through the transport channels 508 of the load sleeve 303, the manifold 335 of the coupling joint 301 and the transport channels 608 in the torque sleeve 305. Additionally, the secondary flow path includes shunt tubes 308 residing external to the base pipes 310 and within the annular region 318.

Additional details concerning the load sleeve 303, the torque sleeve 305 and the coupling joint 301 are provided in U.S. Pat. No. 7,938,184 and in U.S. Pat. No. 7,661,476. The '184 patent is entitled "Wellbore Method and Apparatus for Completion, Production and Injection," and issued in 2011. The '476 patent is entitled "Gravel Packing Methods." FIGS. 3A, 3B, 3C, 4A, 4B, 5A, 5B, 6 and 7 of the '184 patent present details concerning components of a joint assembly in the context of using a sand screen. These figures and accompanying text and all descriptions in the '184 and '476 patents related to sand screen assemblies are incorporated herein by reference.

To provide a fluid seal along the coupling assemblies 301, o-rings are provided. An o-ring resides along a shoulder 610 between the torque sleeve 305 and the connected coupling joint, while an o-ring resides along a shoulder 512 between the load sleeve and the connected coupling joint 301.

The sand screen assembly 300 preferably works in conjunction with a packer assembly. The packer assembly comprises at least one sealing element disposed at an end of either the first base pipe or the second base pipe opposite the coupling assembly. The sealing elements are configured to be actuated to engage a surrounding wellbore wall. The packer assembly also has an inner mandrel which forms a part of the primary flow path.

The sealing element for the packer assembly may include a mechanically-set packer. More preferably, the packer assembly has two mechanically-set packers or annular seals. These represent an upper packer and a lower packer, as shown in FIG. 1A. Each mechanically-set packer has a sealing element that may be, for example, from about 6 inches (15.2 cm) to 24 inches (61.0 cm) in length. Each mechanically-set packer also has an inner mandrel in fluid communication with the base pipe of the sand screens.

As noted, the sand screen assembly 300 is designed to be run into an open-hole portion (120A or 120B) of a wellbore. The sand screen assembly 300 is ideally run in pre-connected sand screen joints that are threadedly connected. Sections of pre-connected joints are then connected at the rig using a coupling assembly, such as the assembly 301 of FIG. 4A. The coupling assembly 301 will preferably include a load sleeve (such as the load sleeve 303 of FIGS. 5A and 5B) a torque sleeve (such as the torque sleeve 305 of FIG. 6) and an intermediate coupling joint (such as the coupling joint 301 of FIG. 4B).

Figure 7A:
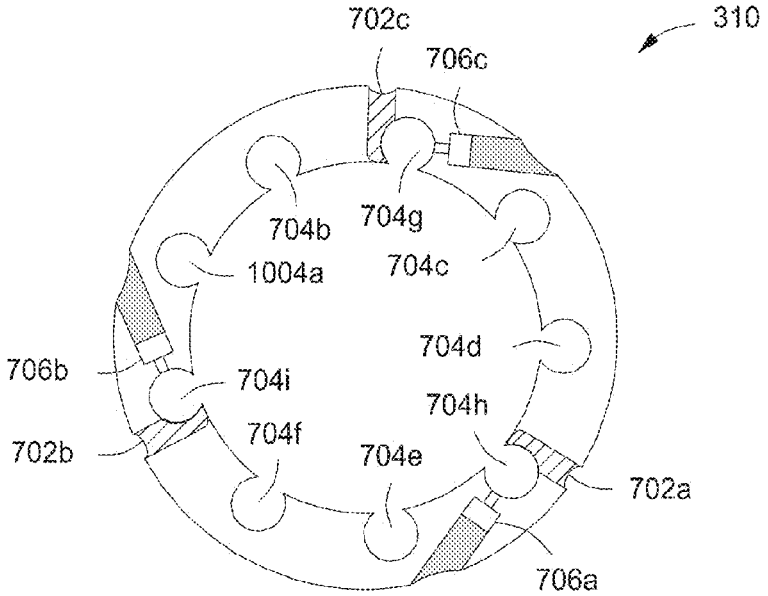
FIG. 7A (Prior Art)
FIG. 7A is a cross-sectional view of a previously-known nozzle ring utilized for sand screen assemblies have alternate flow path technology.

As noted, the sand screen assembly 300 further includes at least one nozzle ring 310 positioned along its length. In the arrangement of FIG. 3A, nozzle rings are shown in series at 310*a*, 310*b*, . . . 310*e*. FIG. 7A is an end view of an exemplary embodiment of a known nozzle ring 310. The nozzle ring 310 is adapted and configured to fit around the base pipe 320 and to connect with shunt tubes 308*a*-308*i*. Preferably, the nozzle ring 310 includes at least one channel 704*a*-704*i* to accept the at least one shunt tube 308*a*-308*i*. Each channel 704*a*-704*i* extends through the nozzle ring 310 from an upstream or first end to a downstream or second end.

For each packing tube 308*g*-308*i*, the nozzle ring 310 includes an opening or hole 702*a*-702*c*. Each hole 702*a*-702*c* extends from an outer surface of the nozzle ring 310 toward a central point of the nozzle ring 310 in the radial direction. Each hole 702*a*-702*c* interferes with or intersects, at least partially, the at least one channel 704*a*-704*c* such that they are in fluid flow communication. A wedge (not shown) may be inserted into each hole 702*a*-702*c* such that a force is applied against a shunt tube 308*g*-308*i* pressing the shunt tube 308*g*-308*i* against the opposite side of the channel wall. For each channel 704*a*-704*i* having an interfering hole 702*a*-702*c*, there is also an outlet 706*a*-706*c* extending from the channel wall through the nozzle ring 310. The outlet 706*a*-706*c* has a central axis oriented perpendicular to the central axis of the hole 702*a*-702*c*. Each shunt tube 308*g*-308*i* inserted through a channel having a hole 702*a*-702*c* includes a perforation in fluid flow communication with an outlet 706*a*-706*c* and each outlet 706*a*-706*c* preferably includes a nozzle insert (not shown).

Figure 7B:
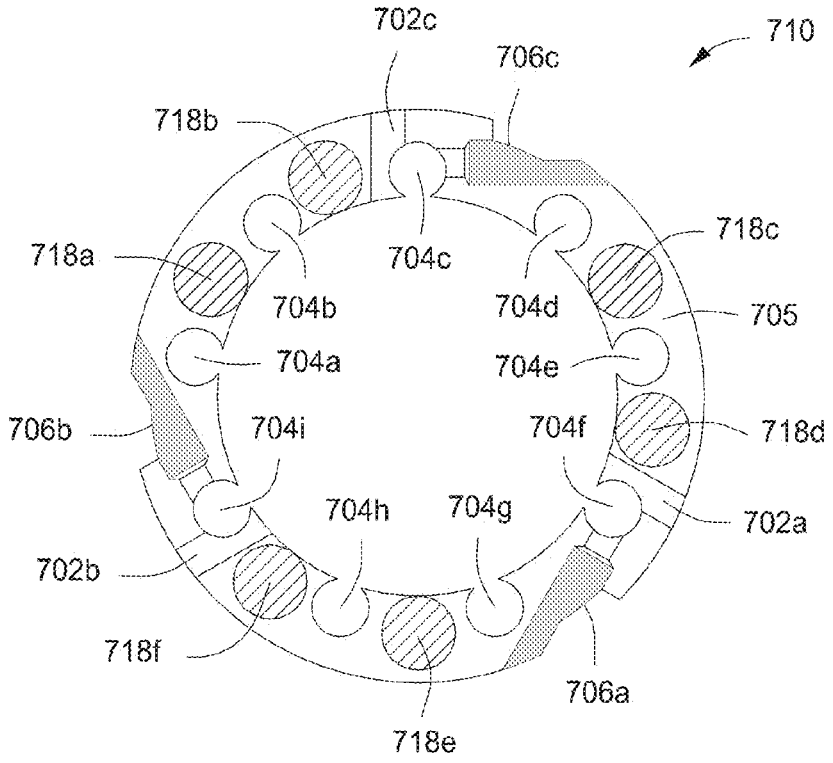
FIG. 7B is a cross-sectional view of a new nozzle ring designed to be used along the sand screen assembly of FIG. 3A. Radially-disposed openings for receiving shunt tubes are seen extending through the nozzle ring, representing openings for receiving gravel tubes and packing tubes. In addition, fluid-flow openings are radially-disposed about the nozzle ring to facilitate the flow of wellbore fluids.

FIG. 7B is a cross-sectional view of a new nozzle ring 710 designed to be used along the sand screen assembly 300 of FIG. 3A. Nozzle ring 710 is intended to represent a preferred embodiment for the plurality of nozzle rings 310*a*-310*e* utilized in the sand screen assembly 300 of FIG. 3A.

In nozzle ring 710, radially-disposed openings 708 for receiving shunt tubes 308 are again seen extending through the nozzle ring 710. These represent openings for receiving gravel tubes and packing tubes. In addition, new fluid-flow openings 718 are radially-disposed about the nozzle ring 710. These are designated as 718*a*, 718*b*, . . . 718*f*. Thus, in the embodiment of FIG. 7B, six fluid-flow openings 718 are employed.

The fluid-flow openings 718 are designed to permit wellbore fluids to flow along the annular area 318 of a sand screen assembly 300 from one screen joint 314 to an adjacent screen joint 314. During a production operation, the fluid-flow openings 718 facilitate the flow of production fluids from the annular flow path around the base pipe 320, and into an in-flow control section (discussed further below). Ultimately, production fluids will flow through production fluid openings in the base pipe 320 (shown schematically, for example, at 915 in FIG. 9B), into the bore 315 of the base pipe 320, and up to the surface 101.

Figure 7C:
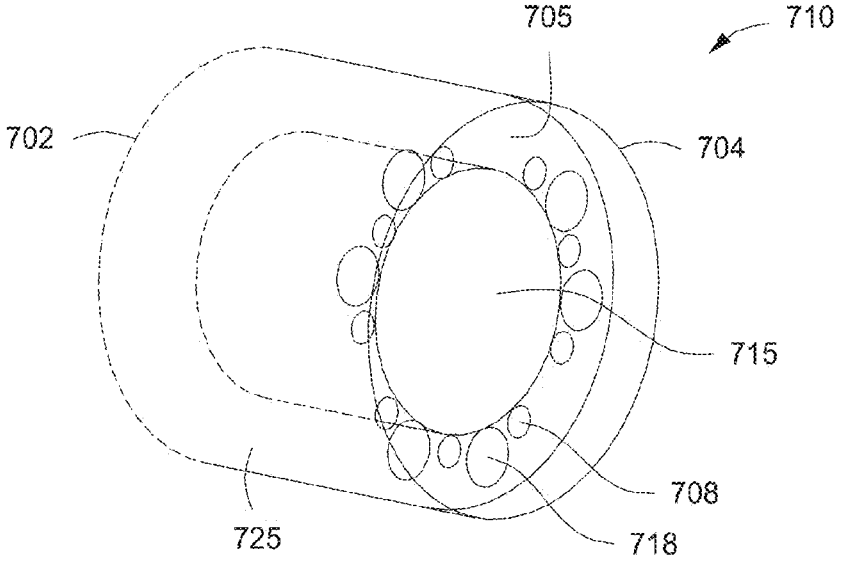
FIG. 7C is a perspective view of the nozzle ring of FIG. 7B. Various radially-disposed openings for receiving shunt tubes and for transmitting wellbore fluids are seen.

FIG. 7C is a perspective view of the nozzle ring 700 of FIG. 7B. The nozzle ring 710 is seen more clearly as a short tubular body. The nozzle ring 710 has a wall 725 forming an outer diameter and an inner bore 715. The bore 715 aligns with the bore 315 of the base pipe 320 for carrying production fluids.

Between the inner bore 705 and the outer diameter 725 are a plurality of aligned openings. Radially-disposed openings 708 are provided for receiving shunt tubes 308. The shunt tubes are passing through openings 708 for transmitting gravel slurry. Alternatively, the shunt tubes 308 sealingly terminate at opposing ends 702, 704 of the nozzle ring 710 for transmitting gravel slurry. In addition, radially disposed fluid-flow openings 718 for transmitting wellbore fluids are again seen.

In addition to the nozzle rings 710, the sand screen assembly 300 includes a novel in-flow control section. The in-flow control section is not seen in FIG. 3A; however, in-flow control sections of various arrangements are shown in FIGS. 9B, 10B, 11B and 12B, discussed below. Each of the in-flow control sections includes or works in conjunction with a nozzle ring 710. In addition, each of the in-flow control sections uses or works in conjunction with a transition ring 800. The transition rings 800 are generally shaped in accordance with the nozzle rings 710. In this respect, each transition ring 800 includes a cylindrical body having an inner diameter and an outer diameter, wherein the inner diameter receives a base pipe 320, and the body receives gravel slurry transport conduits (along with conduits 708) and fluid-flow conduits (aligned with fluid-flow openings 718).

The in-flow control section gives the operator the ability to control the flow of production fluids into the wellbore at a particular depth or along a particular zone. More particularly, the in-flow control section controls fluid flow into the base pipe of a particular sand screen assembly 300 after a gravel packing operation has been completed.

It is observed here that WIPO Publ. No. WO 2007/126496 entitled "Wellbore Method and Apparatus for Sand and Inflow Control During Wellbore Operations" discloses several methods for restricting or closing off the flow of production fluids into a section or joint of sand screen. In each technique, a base pipe was provided within a sand screen joint. At an end (or along a section of) the base pipe, production openings are provided. The production openings receive production fluids during a production operation. The methods of WIPO Publ. No. WO 2007/126496 offer a "barrier element" for selectively restricting the flow of production fluids into the base pipe. The barrier element includes a swellable packer around the base pipe. An ICD or a tubular conduit may be used in conjunction with the swellable packer. Alternatively, a sliding sleeve (or, alternatively, a rotating sleeve) for partially or completely covering the production openings may be used as the barrier element for in-flow control.

Figure 8A:
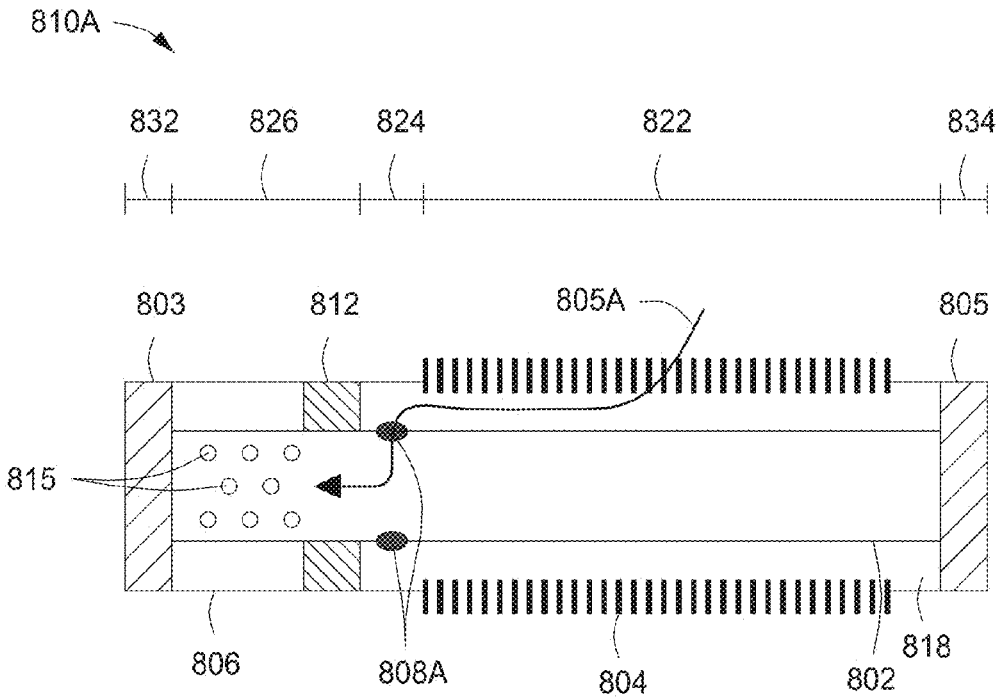
FIGS. 8A and 8B demonstrate the use of an ICD with a swellable packer element in a sand screen. In each of these figures, a packer element has expanded, sealing the annular area between a base pipe and a surrounding impermeable housing.
Figure 8B:
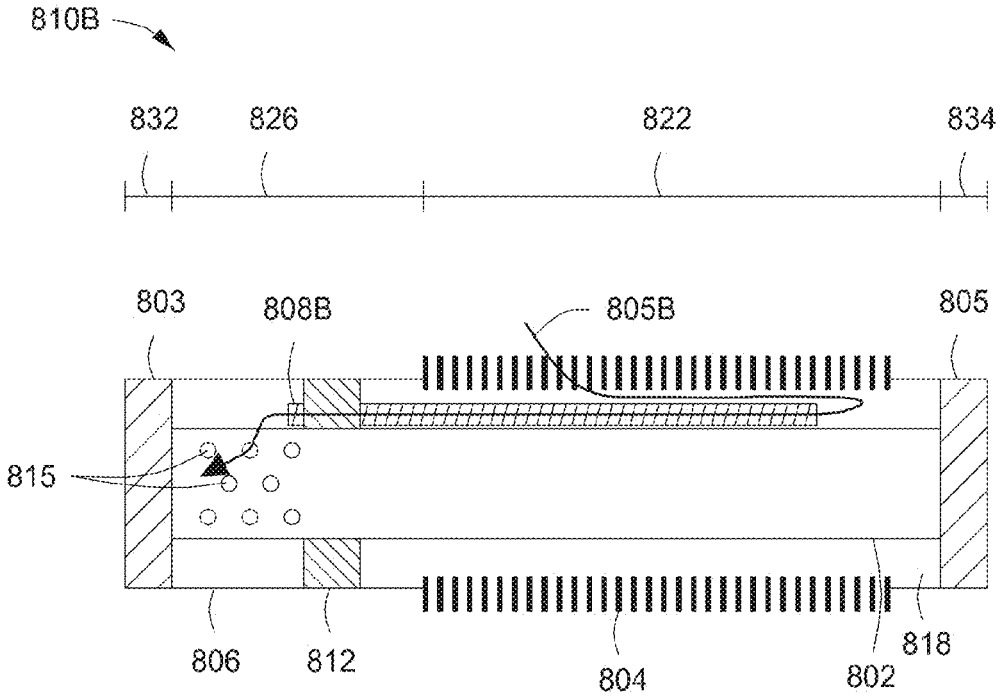

FIGS. 8A and 8B demonstrate the use of an ICD with a swellable packer element 812. In each of these figures, a packer element 812 has expanded, sealing the annular area 818 between a base pipe 802 and a surrounding impermeable housing 806. In FIG. 8A, the in-flow control device 808A (openings) are used as the ICD; in FIG. 8B, a tubular conduit 808B is used as the ICD. It is noted that these views are taken from FIGS. 7B and 8A of WIPO Publ. No. WO 2007/126496.

In FIG. 8A, the in-flow control device 808A is part of a sand control device 810A that includes various sections. These include a main body section 822, an inflow section 824, a perforated section 826, a first connection section 832 and a second connection section 834, which are made of steel or metal alloys. The connection sections 832, 834 represent threaded connectors 803, 805, but are not a load sleeve or a torque sleeve. The inflow section 824 represents a sand screen 804. A restricted flow of production fluids from the sand screen 804 and into the bore of the base pipe 802 is shown by arrow 805A. Fluids move into production fluid openings 815 according to the path of arrow 805A.

In FIG. 8B, the in-flow control device 808B is also part of a sand control device 810B that includes various sections. These include a main body section 802, a perforated section 826, a first connection section 832 and a second connection section 834, which may be made from steel or metal alloys. The connection sections 832, 834 again represent threaded connectors 803, 805, but are not a load sleeve or a torque sleeve. The inflow section 824 represents a sand screen 804. A restricted flow of production fluids from the sand screen 804 and into the bore of the base pipe 802 is shown by arrow 805B. Fluids move into production fluid openings 815 according to the path of arrow 805B.

Figure 8C:
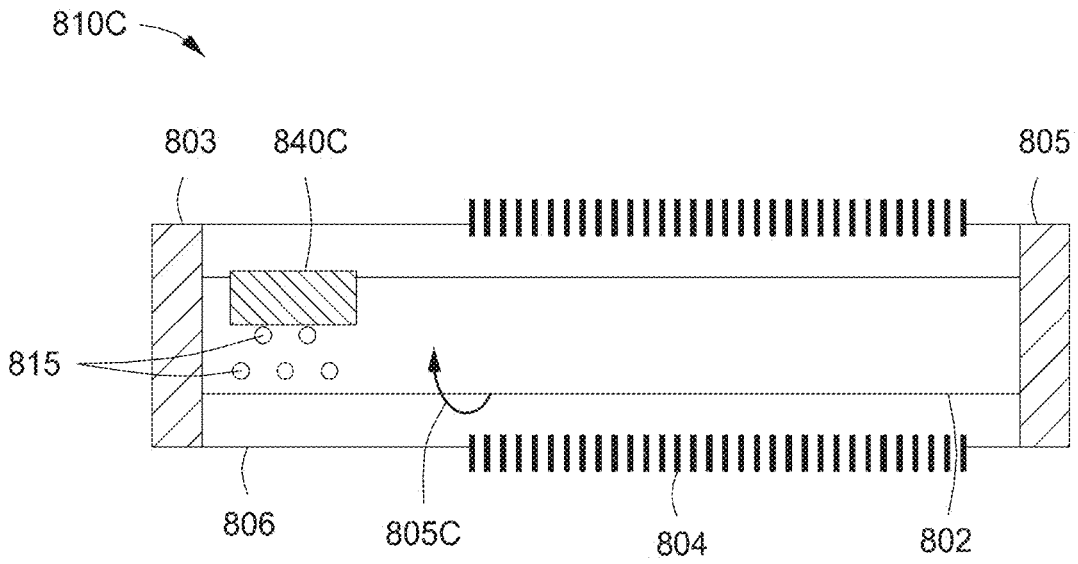
FIGS. 8C and 8D demonstrate the use of an ICD without a swellable element. In each of these figures, a sleeve is moved to partially or completely cover production fluid openings.
Figure 8D:
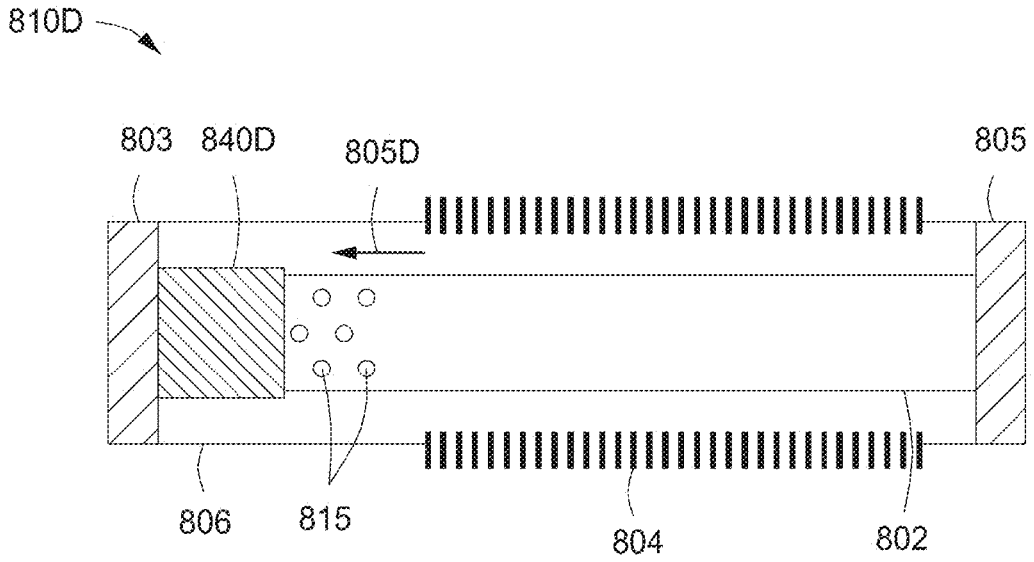

FIGS. 8C and 8D demonstrate the use of an ICD without a swellable element. In each of these figures, a sleeve is moved to partially or completely cover the production openings 815. Thus, the sleeve serves as the barrier element.

In FIG. 8C, a sand screen 810C is provided. The sand screen 810C includes a base pipe 802 and a surrounding sand screen 804. A rotating sleeve 840C is used as the ICD to selectively cover the production fluid openings 815. Arrow 805C indicates a direction of movement of the sleeve 840C. It is understood that when the sleeve 840C is open, production fluids will travel from the sand screen 804 into the bore of the base pipe 802 via production fluid openings 815.

In FIG. 8D, a sand screen 810D is again provided. The sand screen 810D includes a base pipe 802 and a surrounding sand screen 804. Here, a sliding sleeve 840D is used as the ICD to selectively cover the production fluid openings 815. Arrow 805D indicates a direction of movement of the sleeve 840D. It is understood that when the sleeve 840D is open, production fluids will travel from the sand screen 804 into the bore of the base pipe 802 via production fluid openings 815.

Figure 11A:
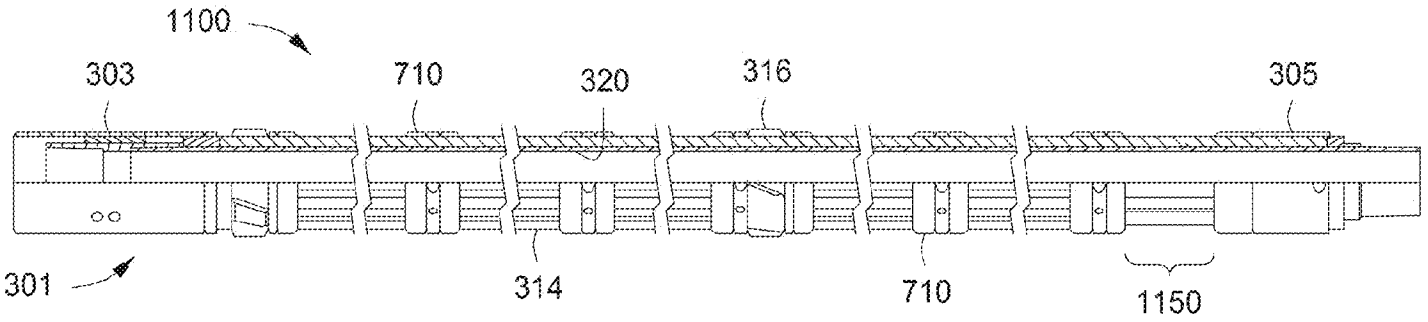
FIG. 11A is a longitudinal, partial cross-sectional view of the coupling assembly of FIG. 3A, in still another alternate embodiment. An ICD Section is placed adjacent the torque sleeve.
Figure 11B:
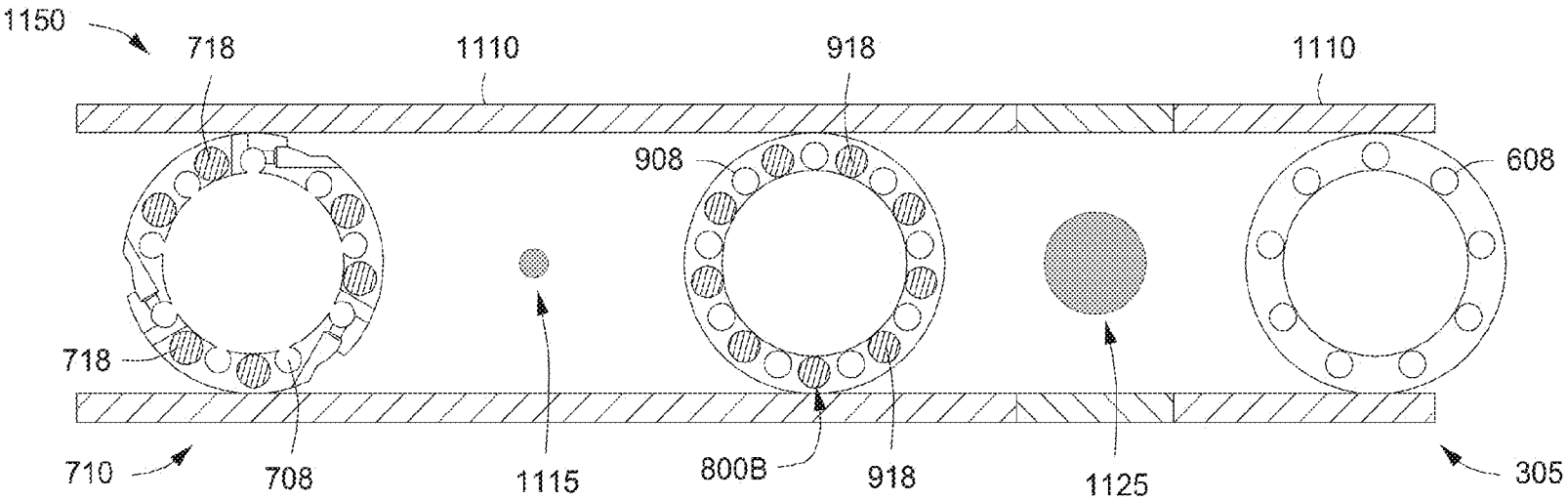
FIG. 11B is an enlarged view of the ICD Section of FIG. 11A. A nozzle ring, a transition ring and the torque sleeve are shown in cross-section for demonstrative purposes. Small production fluid openings in the base pipe are used to control production fluid in-flow.

It is noted that the views of FIGS. 8C and 8D are taken from FIGS. 11B and 11E of WIPO Publ. No. WO 2007/126496. WIPO Publ. No. WO 2007/126496 contains additional details about the use of ICD's along a sand screen, and is incorporated herein by reference in its entirety. However, modifications of the ICD arrangements of WIPO Publ. No. WO 2007/126496 are desirable when the load sleeve 303, the torque sleeve 305 and the transport conduits 308 are used. In this respect, it is desirable during gravel packing to offer a flow path for fluid leak-off into the base pipe that is less restrictive, and then a flow path for production fluids into the base pipe during production operations that is selectively more restrictive. Accordingly, various novel in-flow control sections 950, 1050, 1150 and 1250 are offered herein that meet this criteria.

Figure 9A:
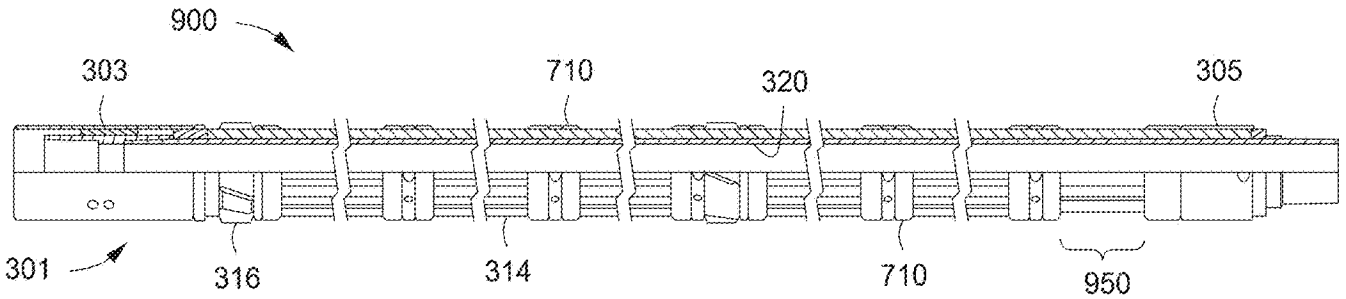
FIG. 9A is a longitudinal, partial cross-sectional view of the coupling assembly of FIG. 3A, in one embodiment. An "ICD Section" is placed adjacent the torque sleeve.

FIG. 9A is a longitudinal, partial cross-sectional view of the sand screen assembly 300 of FIG. 3A, in one embodiment. Here, the sand screen assembly is designated as 900. A section 950 is indicated in the sand screen assembly 900 as receiving an "ICD Section." This represents an in-flow control section. The in-flow control section 950 resides at an end of the assembly 900 adjacent the torque sleeve 500.

Figure 9B:
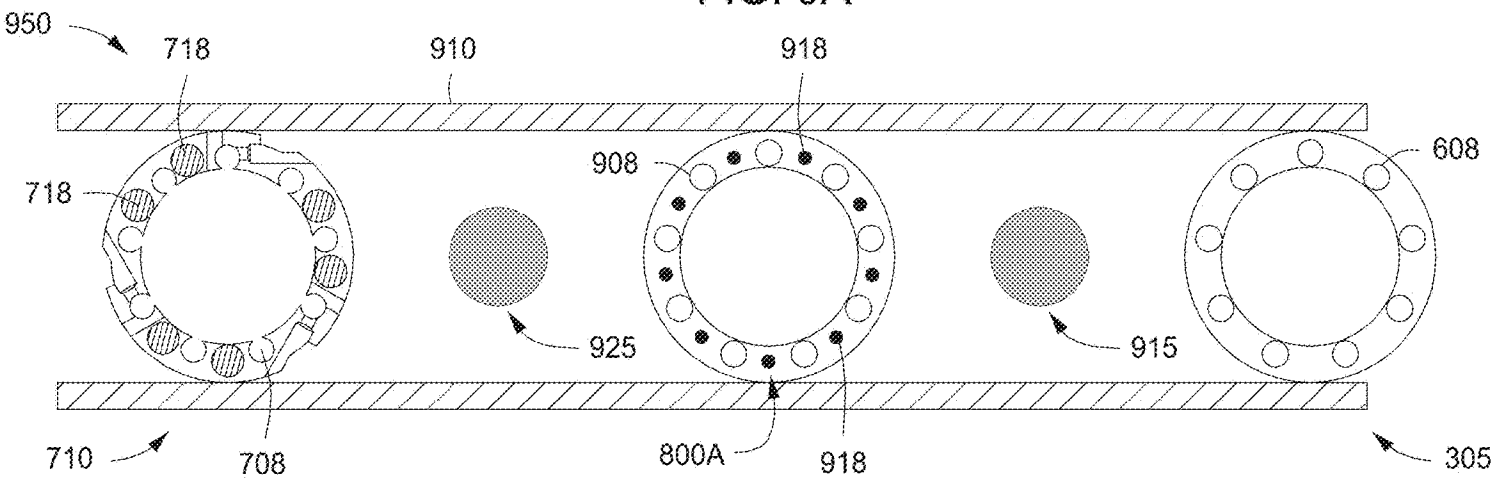
FIG. 9B is an enlarged view of the ICD Section of FIG. 9A. A nozzle ring, a transition ring and the torque sleeve are shown along the illustrative ICD Section in cross-section for demonstrative purposes. Small fluid-flow openings in the transition ring are used to control production fluid in-flow.

FIG. 9B is an enlarged view of the ICD Section 950 of FIG. 9A. In this view, the ICD section 950 comprises a nozzle ring 710, a transition ring 800A and the torque sleeve 305, in series. The nozzle ring 710, the transition ring 800A and the torque sleeve 305 are shown along the illustrative ICD Section 950 in cross-section for illustrative purposes. However, it is understood that these are actually short tubular bodies as described above.

Intermediate the nozzle ring 710 and the transition ring 800A is a gravel packing opening 925. The gravel packing opening 925 is shown somewhat schematically. It is understood that the gravel packing opening 925 is actually one or more openings formed in the wall of the base pipe 320 that permits fluid leak-off during a gravel packing operation. Preferably, three equi-distantly spaced gravel packing openings 925 are spaced radially about the base pipe 320.

Intermediate the transition ring 800A and the torque sleeve 305 is a production fluids opening 915. The production fluids opening 915 is also shown somewhat schematically. It is understood that the production fluids opening 915 is actually one or more openings formed in the wall of the base pipe 320 that permits production fluids to flow into the base pipe 320 during a production operation. Preferably, four equi-distantly spaced production fluid openings 915 are spaced radially about the base pipe 320.

A housing 910 is provided for the in-flow control section 950. Preferably, the housing 910 is an impermeable tubular body that extends from the nozzle ring 710 all the way to the torque sleeve 305. This forces fluids flowing into the in-flow control section 950 to flow through the appropriate openings 708, 718 around the nozzle ring 710. In the arrangement of FIG. 9B, the portion of the housing 910 extending from the nozzle ring 710 to the transition ring 800A could optionally be a part of the filter medium 330.

In operation, during the gravel packing stage of the wellbore completion process, gravel slurry is pumped down the annulus between the sand screen assemblies and the surrounding open hole wellbore. As sand packs along the wellbore, fluid leak-off flows through the filter media 330 along each sand screen assembly 300. At the same time, slurry flows through the shunt tubes 308 along the sand screens and exits through packing conduits 308*a*-308*c* to bypass any sand bridges and to ensure a complete gravel pack. As pressure in the annulus builds, fluid leak-off will flow through the filter media 330 and into the radially-disposed openings 718 in the nozzle ring 710. Leak-off will further flow into the gravel packing opening(s) 925. In addition, some slurry will likely flow through separate radially-disposed openings 908 in the transition ring 800A and then into the production fluids opening 915. This leak-off process will continue until pumping pressure readings at the surface indicate that a complete gravel pack has been formed.

The operator will subsequently activate a cross-over sleeve (not shown) to circulate out any slurry from the bore 315 and up to the surface 101. Additional steps used for conducting a gravel packing operation, such as pulling the coiled tubing used for pumping slurry, are well-known to those of ordinary skill in the art and need not be set forth herein.

Once the gravel packing process and other completion steps are taken, including the setting of any packers between sand control assemblies, production operations may begin. The operator will open the well to production and bring wellbore fluids from various producing zones 165*a*, 165*b*, etc. up to the surface 101. However, during this process, it is desirable that the flow path into the bore 315 be more restricted than the flow path during the gravel packing process. In the arrangement of FIG. 9B, the gravel packing opening 925 is closed by the operator to satisfy this desire.

Figure 9C:
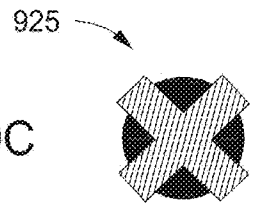
FIG. 9C indicates that one or more gravel packing openings along the base pipe of FIG. 9A in the ICD Section has been closed. This occurs after gravel packing is complete.

FIG. 9C indicates that a gravel packing opening 925 along the base pipe 320 of FIG. 9A in the ICD Section 950 has been closed. This occurs after gravel packing but preferably before production commences. In one aspect, the gravel packing opening 925 is closed in response to the degradation of a material, e.g., disclosed in U.S. Patent Publ. No. 2015/0027700. For example, a spring (not shown) may hold a valve in an open position for a period of time in response to a restraining force of the material. The material dissolves or degrades over time in the presence of a fluid or an elevated temperature. Over time, the material will dissolve or degrade to the point that it no longer acts on the spring, allowing the valve to close.

Once the gravel packing opening 925 is closed and production operations commence, production fluids will enter the in-flow control section 950 through the plurality of fluid-fluid openings 718 in the nozzle ring 710. From there, production fluids will flow through a separate plurality of production fluid openings 918 in the transition ring 800A. From there, production fluids will further flow through the production fluids opening(s) 915 in the base pipe 320 for transport to the surface 101.

It is observed that the production fluid openings 918 in the transition ring 800A are optionally smaller than the production fluid openings 718 in the nozzle ring 710. This is by design. The sand screen assembly 900 is configured so that the in-flow of production fluids is tuned to limit flow. This may be desirable, for example, to ensure that production fluids from another zone having a lower formation pressure are able to enter the base pipe 320 and flow up to the production tubing 130. Alternatively or in addition, this may be desirable to ensure that production fluids from a zone that is subject to higher hydrostatic head pressures are able to enter the base pipe 320 and flow up to the production tubing 130.

In some instances, the operator may even desire to close off the flow of production fluids into a sand screen assembly along a specific zone of interest. In this instance, one of the ICD's disclosed in WIPO Publ. No. WO 2007/126496, discussed above, may be activated to completely close off the production fluids opening(s) 915.

Other arrangements for an ICD section may be provided. For example, instead of placing the ICD section adjacent the torque sleeve 305 (as shown in FIG. 9B), the ICD section may be placed at the opposite end of the sand screen assembly 300 adjacent the load sleeve 303. Such an arrangement is presented in FIGS. 10A and 10B.

Figure 10A:
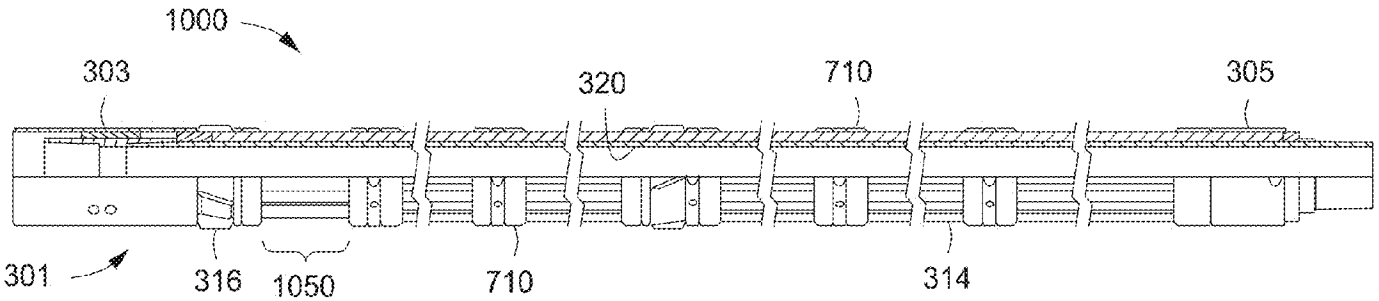
FIG. 10A is a longitudinal, partial cross-sectional view of the coupling assembly of FIG. 3A, in an alternate embodiment. An ICD Section is again indicated. Here, the ICD Section is placed adjacent the load sleeve.

FIG. 10A is a longitudinal, partial cross-sectional view of the sand screen assembly 300 of FIG. 3A, in an alternate embodiment. Here, the sand screen assembly is designated as 1000. A section 1050 is indicated in the sand screen assembly 1000 as receiving an "ICD Section." This again represents an in-flow control section. Here, the in-flow control section 1050 resides at an end of the assembly 1000 adjacent the load sleeve 303.

Figure 10B:
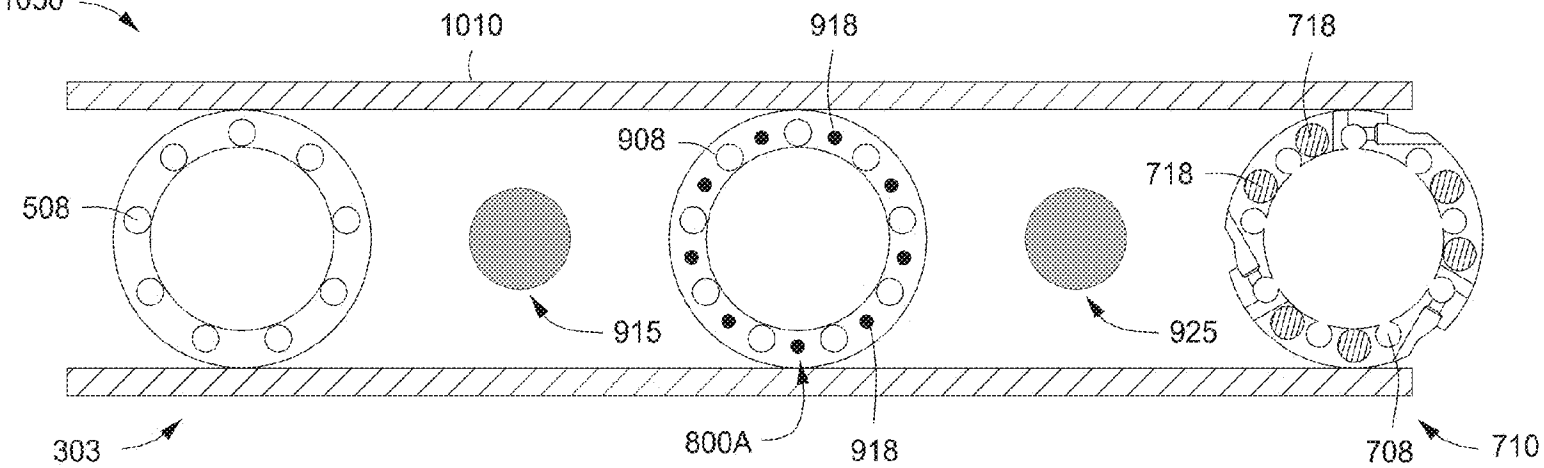
FIG. 10B is an enlarged view of the ICD Section of FIG. 10A. A load sleeve, a transition ring and a nozzle ring are shown in cross-section for demonstrative purposes. Small fluid-flow openings in the transition ring are again used to control production fluid in-flow.

FIG. 10B is an enlarged view of the ICD Section 1050 of FIG. 10A. In this view, the ICD section 1050 comprises a load sleeve 303, a transition ring 800A and a nozzle ring 710 in series. The load sleeve 303, the transition ring 800A and the nozzle ring 710 are shown along the illustrative ICD Section 1050 in cross-section for illustrative purposes. However, it is again understood that these are actually short tubular bodies as described above.

The ICD Section 1050 operates in accordance with the ICD Section 950 described above, but in reverse. The gravel packing opening(s) 925 remains intermediate the nozzle ring 710 and the transition ring 800A. Similarly, the production fluids opening(s) 915 remains intermediate the transition ring 800A and the load sleeve 303. A "blank" housing 1010 is provided for the in-flow control section 1050 around the components to force fluids flowing into the in-flow control section 1050 to flow through the appropriate openings 708, 718 around the nozzle ring 710.

Once the gravel packing opening(s) 925 is closed and production operations commence, production fluids will enter the in-flow control section 1050 through the plurality of production fluid openings 718 in the nozzle ring 710. From there, production fluids will flow through a separate plurality of production fluid openings 918 in the transition ring 800A. From there, production fluids will further flow through the production fluids opening(s) 915 in the base pipe 320 for transport to the surface 101.

Figure 10C:
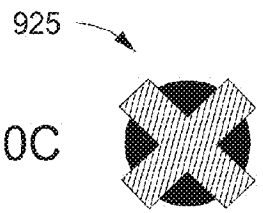
FIG. 10C indicates that one or more gravel packing openings along the base pipe of FIG. 10A in the ICD Section has been closed. This again occurs after gravel packing has been completed.

FIG. 10C is a mirror image of FIG. 9C. This demonstrates the step of closing the gravel packing opening(s) after gravel packing, and preferably before production operations commence. This further ensures that the fluid flow into the bore 315 of the base pipe 320 path during gravel packing is less restrictive than during production operations.

The following Table 1 demonstrates the order of components in FIGS. 9B and 10B:

TABLE 1

| | | | | | |
|---|---|---|---|---|---|
| FIG. 9B | Nozzle ring 710 | Gravel Packing Opening 925 | Pre-Tuned Transition Ring 800A | Production Fluids Opening 915 | Torque Sleeve 305 |
| FIG. 10B | Load Sleeve 303 | Production Fluids Opening 915 | Pre-Tuned Transition Ring 800A | Gravel Packing Opening 925 | Nozzle ring 710 |

It is noted that the sand screen assembly 300 may include in-flow control devices at both ends, that is, ICD Section 950 at an end adjacent the torque sleeve 305, and ICD Section 1050 adjacent the load sleeve 303. ICD Sections 950 and 1050 are mirror images of one another. It is further understood that the positions of the load sleeve 303 and the torque sleeve 305 may be reversed, depending on how the operator arranges the coupling assembly 301.

As an alternative to the embodiments of FIGS. 9B and 10B, the operator may substitute second transition rings 800A for the nozzle rings 710. In this embodiment, the gravel packing opening(s) 925 will reside between two transition rings 800A. The following Table 2 demonstrates the order of components in modified FIGS. 9B and 10B:

TABLE 2

| | | | | | |
|---|---|---|---|---|---|
| FIG. 9B Modified | Pre-Tuned Transition Ring 800A | Gravel Packing Opening 925 | Pre-Tuned Transition Ring 800A | Production Fluids Opening 915 | Torque Sleeve 305 |
| FIG. 10B Modified | Load Sleeve 303 | Production Fluids Opening 915 | Pre-Tuned Transition Ring 800A | Gravel Packing Opening 925 | Pre-Tuned Transition Ring 800A |

As another alternative to the embodiments of FIGS. 9B and 10B, the operator may relocate the nozzle ring 710 and gravel packing opening 925 to the opposite end of the sand screen assembly, and reverse the order of the nozzle ring 710 and the gravel packing opening(s) 925. In this case, the housing 910 external to the section where gravel packing opening(s) 925 are positioned could be replaced by a filter media similar to 330. The following Table 3 demonstrates these options:

TABLE 3

| | | | | | |
|---|---|---|---|---|---|
| Load Sleeve 303 | Gravel Packing Opening 925 | Nozzle Ring 710 | Pre-Tuned Transition Ring 800A | Production Fluids Opening 915 | Torque Sleeve 305 |
| Load Sleeve 303 | Gravel Packing Opening 925 | Pre-Tuned Transition Ring 800A | Pre-Tuned Transition Ring 800A | Production Fluids Opening 915 | Torque Sleeve 305 |
| Load Sleeve 303 | Production Fluids Opening 915 | Pre-Tuned Transition Ring 800A | Nozzle Ring 710 | Gravel Packing Opening 925 | Torque Sleeve 305 |
| Load Sleeve 303 | Production Fluids Opening 915 | Pre-Tuned Transition Ring 800A | Pre-Tuned Transition Ring 800A | Gravel Packing Opening 925 | Torque Sleeve 305 |

In one aspect, the operator may place a dissolvable packer around the base pipe 320 between the nozzle ring 710 and the production fluids opening(s) 915. The packer will dissolve shortly after the gravel packing operations commence to permit production fluids to flow into the production fluids opening(s) 915. A dissolvable or degradable packer is disclosed in U.S. Patent Publ. No. 2015/0027700, which is incorporated herein by reference. It is understood that such a packer will need to accommodate the shunt tubes 308 en route to the adjacent sleeve 303 or 305.

Still additional designs for an in-flow control section may be employed. FIG. 11A offers a longitudinal, partial cross-sectional view of the sand screen assembly 300 of FIG. 3A, in an alternate embodiment. Here, the sand screen assembly is designated as 1100. A section 1150 is indicated in the sand screen assembly 1100 as receiving an "ICD Section." This again represents an in-flow control section. Here, the in-flow control section 1050 resides at an end of the assembly 1100 adjacent the torque sleeve 305.

FIG. 11B is an enlarged view of the ICD Section 1150 of FIG. 11A. In this view, the ICD section 1150 comprises a nozzle ring 710, a transition ring 800B and the torque sleeve 305, in series. The nozzle ring 700, the transition ring 800B and the torque sleeve 305 are again shown along the illustrative ICD Section 1150 in cross-section for illustrative purposes. However, it is understood that these are actually short tubular bodies as described above.

In this arrangement, the production fluids opening(s) 1115 resides intermediate the nozzle ring 710 and the transition ring 800B. In addition, the gravel packing opening(s) 1125 resides intermediate the transition ring 800A and the torque sleeve 305. It is again noted that the production fluids opening(s) 1115 and the gravel packing opening(s) 1125 are shown schematically, and that these openings 1115, 1125 actually may represent multiple radially spaced openings around the wall of the base pipe 305 that permit fluids to flow into the base pipe 305 during wellbore operations.

A housing 1110 is provided for the in-flow control section 1150. Preferably, the housing 1110 is an impermeable tubular body that extends from the nozzle ring 710 all the way to the torque sleeve 305. This forces fluids flowing into the in-flow control section 1150 to flow through the appropriate openings 708, 718 around the nozzle ring 710.

In operation, during the gravel packing stage of the wellbore completion process, gravel slurry is pumped down the annulus between the sand screen assemblies and the surrounding open hole wellbore. As sand packs around the screens, fluid leak-off flows through the filter media 330 along each sand screen assembly 300. At the same time, slurry flows through the shunt tubes 308 along the base pipes 320 and exits through packing tubes 308*a*-308*c* to bypass any sand bridges and to ensure a complete gravel pack. As pressure in the annulus builds, the fluid leak-off will flow through the radially-disposed openings 708 in the nozzle ring 710. Leak-off fluid will further flow through separate fluid flow openings 918 in the transition ring 800B and then into the gravel packing opening(s) 1125. This leak-off process will continue until pumping pressure readings at the surface indicate that a complete gravel pack has been formed. Some leak-off fluid will also enter the production fluid opening(s) 1115, but most will flow through the gravel packing opening(s) 1125.

Once the gravel packing process and other completion steps are taken, production operations may begin. The operator will open the well to production and bring wellbore fluids from various producing zones 165*a*, 165*b*, etc. up to the surface 101. However, during this process, it is desirable that the flow path into the bore 315 for production fluids be more restricted than the flow path for sand slurry during the gravel packing process. In the arrangement of FIG. 11B, the gravel packing opening(s) 1125 is closed by the operator. Alternatively, fluid-flow openings 918 in the transition ring 800B are closed.

Figure 11C:
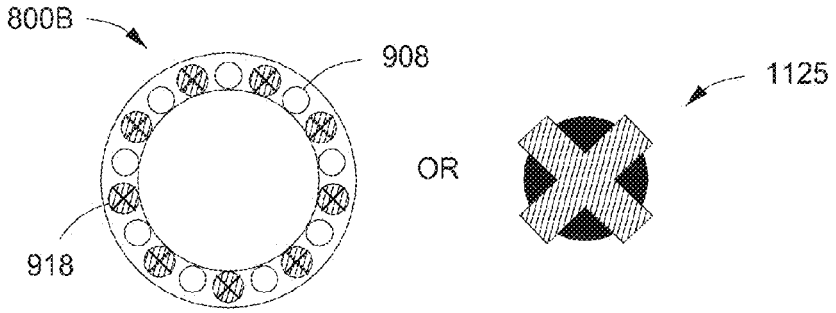
FIG. 11C indicates that through-openings in the transition ring have been closed, thereby sealing off the flow of gravel pack leak-off through the transition ring. This occurs after gravel packing. Alternatively, gravel packing openings in the base pipe adjacent the torque sleeve are closed.

FIG. 11C indicates that the gravel packing opening(s) 1125 in the base pipe 320 adjacent the torque sleeve 305 has been closed. Alternatively, fluid-flow openings 918 in the transition ring 800B are closed, thereby sealing off the flow of fluid through the transition ring 800B. This occurs after gravel packing. In either instance, all production fluids are forced into the production fluids opening(s) 1115.

As an additional adaptive measure, the gravel packing opening(s) 1125 may be, for example, 5 to 10 mm in diameter. At the same time, the production fluids opening(s) 1115 may be, for example, only 1 to 4 mm in diameter. Thus, the cross-sectional flow area for the gravel packing opening(s) 1125 is larger than the cross-sectional flow area for the production fluids opening(s) 1115.

Consistent with the above discussion, it is noted that, as with ICD Sections 950 and 1050 where the location of the in-flow control components may be located at either end of a sand control assembly 300, or both, the ICD Section 1150 also may be located at either end of a sand control assembly 300, or at both ends, with the components being mirror images of one another.

It is also observed that the production fluid opening(s) 1115 of the ICD Section 1150 are themselves tuned for restricted fluid flow. In this respect, the openings 1115 define a limited, pre-determined cross-sectional area for fluid flow. This is in accordance with the wellbore completion considerations discussed above.

The In-Flow Control Section arrangement 1150 of FIG. 11B is similar to the In-Flow Control Section arrangement 950 of FIG. 9B discussed above, except in two respects. The fluid-flow openings 918 in the transition ring 800B are dimensioned to full throttle and do not serve a true ICD function. In addition, the production fluid opening(s) 1115 is dimensioned to be much smaller than production fluid opening(s) 915, and do serve an ICD function. The eight In-Flow Control Section options presented in Tables 1, 2 and 3 can be modified to reflect these variations. Thus, for example, each place the term "Production Fluids Opening 915" is found in Tables 1, 2 and 3, one might instead put "Pre-Tuned Production Fluids Opening 1115" for eight new variations. In addition, each place the term "Pre-Tuned Transition Ring 800A" is found in Tables 1, 2 and 3, one might instead just put "Transition Ring Openings 800B" for eight additional variations. This indicates that the flow-through openings 918 in the transition ring 800B are dimensioned to full throttle.

As an alternative to the use of production fluid openings 1115 having a pre-determined cross-sectional area for fluid flow, an autonomous ICD valve may be employed. The autonomous ICD valve monitors fluid composition, and automatically shuts off (or closes) when unwanted gas or water begin to migrate into the wellbore. In some embodiments, an autonomous ICD valve can sense uneven production distribution between zones. An example of an autonomous in-flow control valve is Halliburton's EquiFlow® autonomous inflow control device (AICD). The EquiFlow® AICD can cease flow restriction if unwanted fluid in-flow recedes.

Figure 12C:
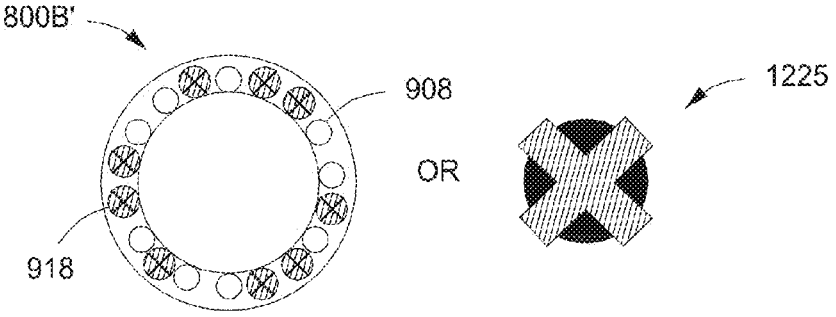
FIG. 12C indicates that through-openings in the transition ring have been closed, thereby sealing off the flow of gravel pack through the transition ring. This occurs after gravel packing is complete. Alternatively, openings in the base pipe adjacent the torque sleeve are closed.
Figure 12D:
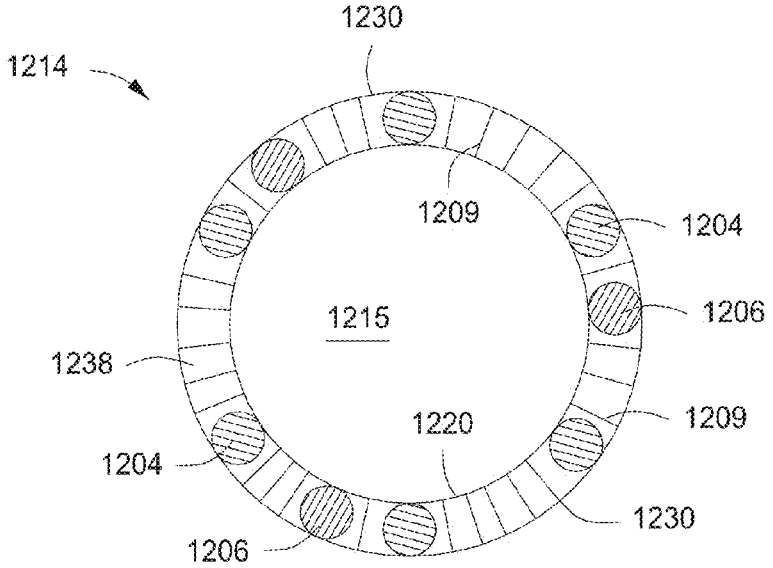
FIG. 12D is a cross-sectional view of a sand screen. This indicates the adjusted positions of gravel tubes and packing tubes when the larger automatic ICD's of FIG. 12B are used for in-flow control.
Figure 12A:
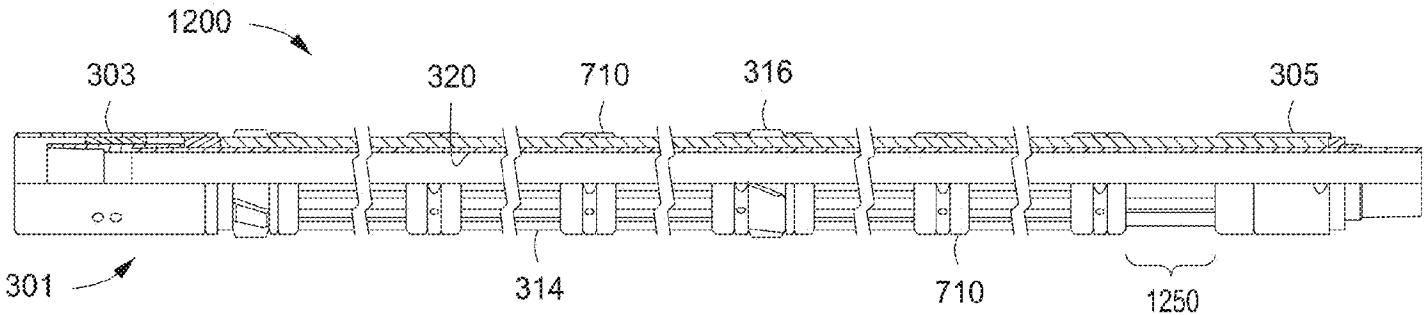
FIG. 12A is a longitudinal, partial cross-sectional view of the coupling assembly of FIG. 3A, in yet another alternate embodiment. An ICD Section again resides adjacent the torque sleeve.

FIG. 12A is a longitudinal, partial cross-sectional view of the sand screen assembly of FIG. 11A, but wherein the production fluids opening is an autonomous ICD. The sand screen assembly is designated as 1200. A section 1250 is indicated as receiving an "ICD Section." The ICD Section 1250 is again adjacent the torque sleeve.

Figure 12B:
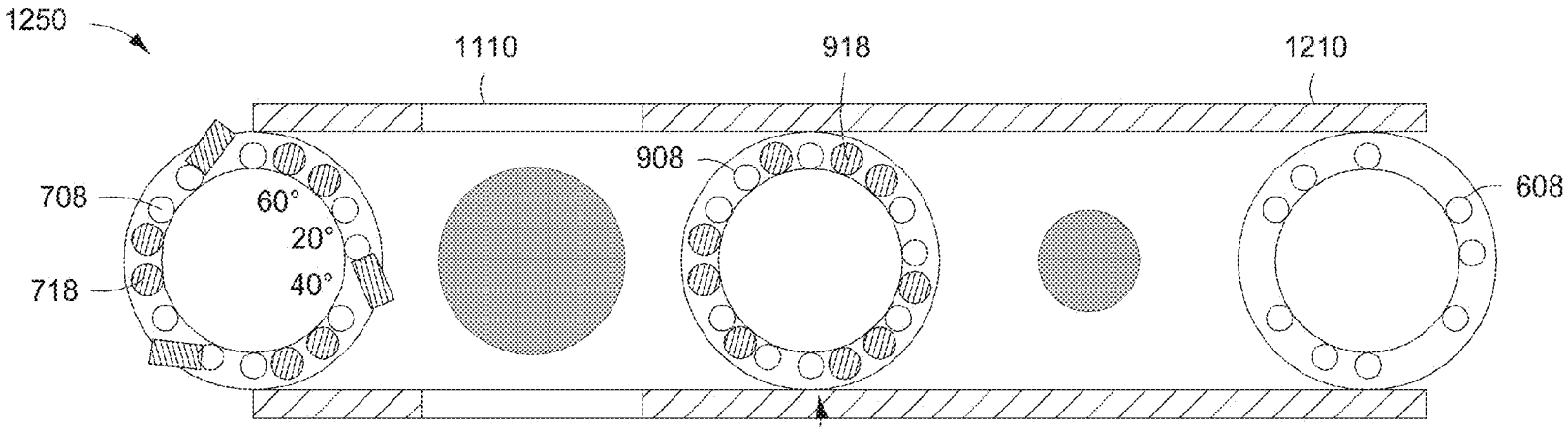
FIG. 12B is an enlarged view of the ICD Section of FIG. 12A. A nozzle ring, a transition ring and the torque sleeve are shown in cross-section for demonstrative purposes. It is seen that the shunt tubes have been re-arranged to accommodate a large automatic ICD along the base pipe, servings as the production fluid openings.

FIG. 12B is an enlarged view of the ICD Section 1250 of FIG. 12A. A nozzle ring 710, a transition ring 800B' and the torque sleeve 305' are shown in cross-section to improve clarity. The component order for the ICD Section 1250 is the same as the component order for the ICD Section 1150 shown in FIGS. 11B and 11C. However, it is observed that the footprint of the known autonomous ICD valve is larger than the spacing desired for the various fluid transport conduits. For example, an individual AICD valve may be as large as 6 cm in diameter. Accordingly, the radial spacing for the gravel slurry transport conduits 708 and for the fluid-flow conduits 718 in the nozzle ring 710 must be adjusted in an asymmetrical manner to accommodate the size of the autonomous ICD 1215 on the base pipe 320. In the same manner, the radial spacing for the gravel slurry transport conduits 908 and for the fluid-flow openings 918 in the transition ring 800B' are adjusted in an asymmetrical manner to align with the gravel slurry transport conduits 708 and the fluid-flow conduits 718 so to accommodate the autonomous ICD 1215. Similarly still, the radial spacing for the gravel slurry transport conduits in the torque sleeve 305' are modified to align with the gravel slurry transport conduits 908 in the transition ring 800B'.

The ICD Section 1250 of FIG. 12B operates in accordance with the ICD Section 1150 of FIG. 11B, except for the use of the autonomous ICD valve 1215. Accordingly, FIG. 12C showing a method for closing off the flow of sand slurry after a gravel packing operation is completed is the same as FIG. 11C.

FIG. 12D is a cross-sectional view of a sand screen 1214 as may be used in the sand screen assembly 1200 of FIG. 12A. This view indicates the adjusted positions of shunt tubes, that is, transport tubes when the larger automatic ICD valve 1215 is used for in-flow control. In FIG. 12D, we see a blank base pipe 1220, and a concentrically surrounding filter medium 1230. Supporting the filter medium 1230 and spacing it from the base pipe 1220 is a plurality of ribs 1209. In the illustrative arrangement of FIG. 12D, 27 ribs 1209 are used.

Intermediate selected ribs is a plurality of gravel shunt tubes. These represent transport tubes 1204 and packing tubes 1206. In the illustrative arrangement of FIG. 12D, six transport tubes 1204 and three packing tubes 1206 are used. The transport tubes 1204 and the packing tubes 1206 reside within an annular flow area 1238 between the base pipe 1220 and the surrounding filter medium 1230.

It is noted that the sand screen assembly 1200 may use the ICD Section 1250 at the opposite end of the sand screen assembly 1200. Alternatively, the sand screen assembly 1200 may use the ICD Section 1250 at both ends, that is, using one ICD Section 1250 at an end adjacent the torque sleeve 305, and one ICD Section 1250 at an end adjacent the load sleeve 303, with the two ICD Sections 1250 being mirror images of one another. It is further understood that the positions of the load sleeve 303 and the torque sleeve 305 may be reversed, depending on how the operator arranges the coupling assembly 301.

It is also noted that whether ICD Section 950, 1050, 1150 or 1250 is used, a series of sand screen assemblies may be place along a wellbore adjacent multiple zones of interest 165*a*, 165*b*, etc. downhole. The sand screen assemblies 900, 1000, 1100, 1200 are designed to be joined end-to-end using the coupling joint 301. The assemblies 900, 1000, 1100, 1200 may be placed in a wellbore that is completed substantially vertically, such as the wellbore 100A shown in FIG. 1A. Alternatively, the sand screen assemblies may be placed longitudinally along a formation 150 that is completed horizontally or that is otherwise deviated, such as the wellbore 100B shown in FIG. 1B. In any arrangement, certain of the sand screen assemblies 900, 1000, 1100, 1200 may optionally be separated by packer assemblies 210 to provide complete zonal isolation.

Figure 13A:
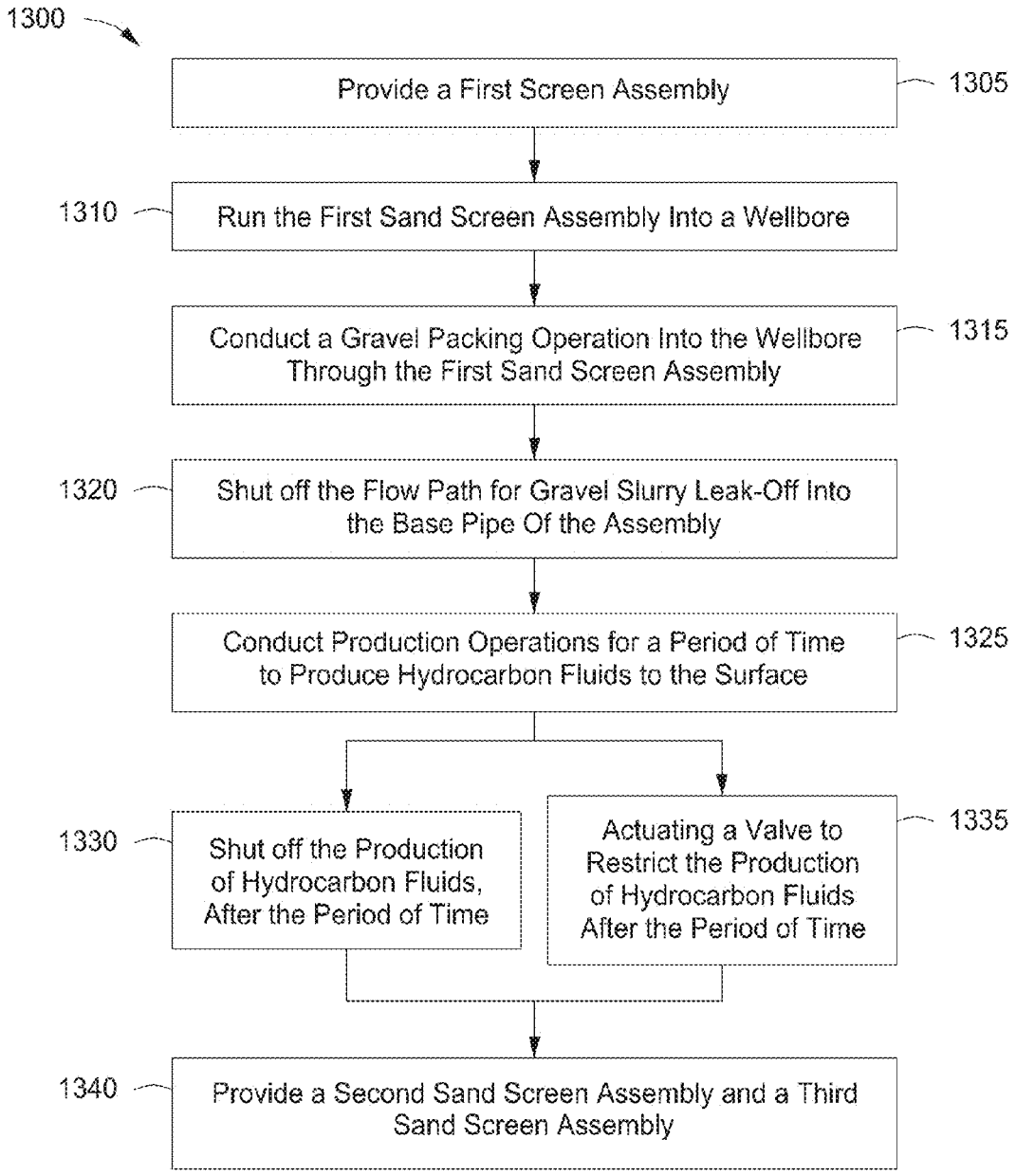
FIGS. 13A and 13B present a single flowchart for a method of completing a wellbore, in one embodiment. The method involves running a sand screen assembly into a wellbore, conducting a gravel packing operation, and then controlling the flow of production fluids into the sand screen.
Figure 13B:
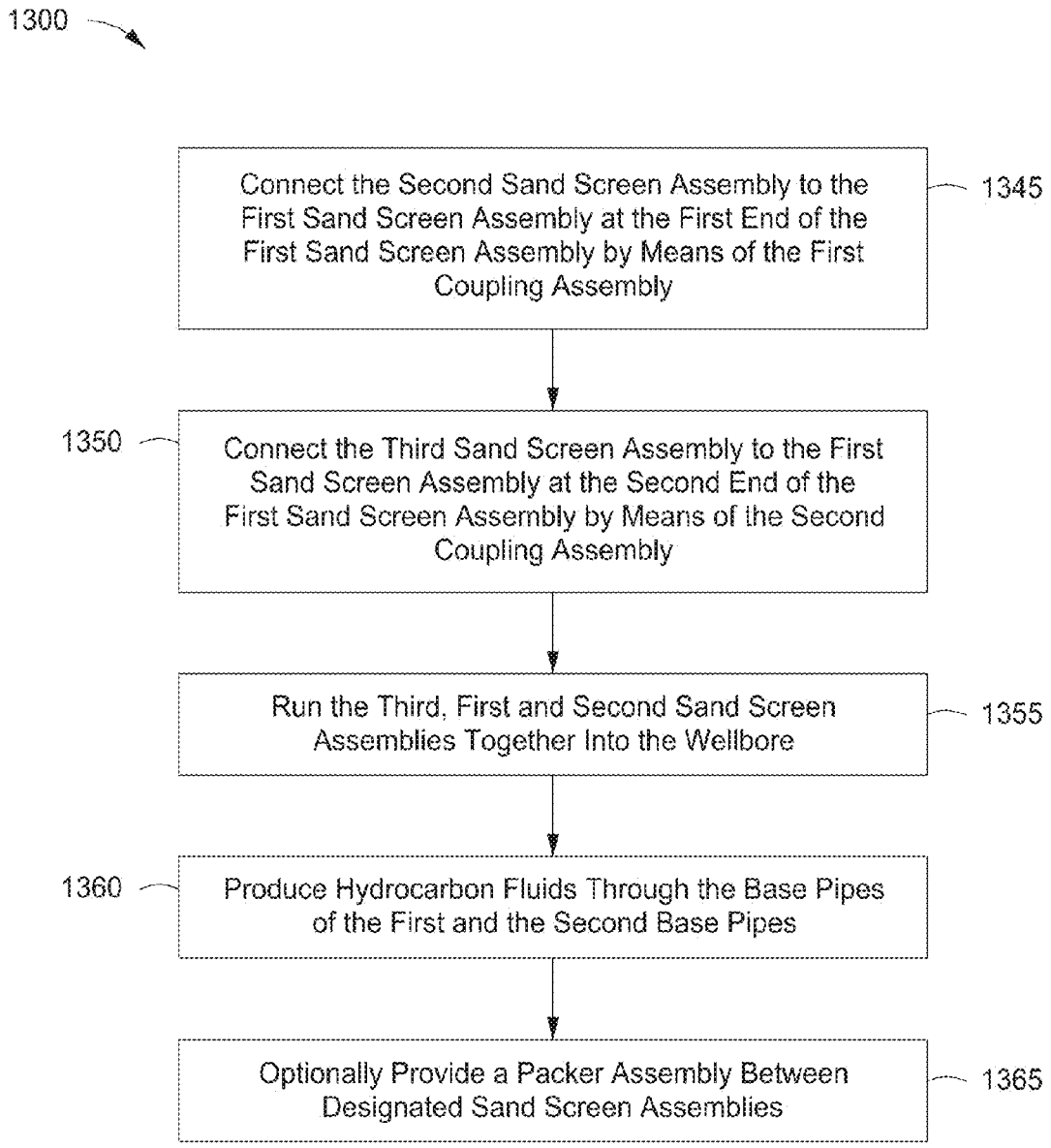

Based on the above descriptions, a method for completing a wellbore is provided herein. The method is presented in FIGS. 13A and 13B. FIGS. 13A and 13B provide a single flow chart presenting steps for a method 1300 of completing a wellbore in a subsurface formation, in certain embodiments. The wellbore preferably includes a lower portion completed as an open-hole. Preferably, the open hole portion is completed horizontally.

In one aspect, the method 1300 first includes providing a first sand screen assembly. This is shown at Box 1305. The first sand screen assembly is constructed in accordance with the sand screen assemblies described above, in their various embodiments. For example, the sand screen assembly includes a base pipe that forms a flow path for production fluids, and a filter media disposed circumferentially around and residing along at least a portion of the base pipe. The filter media creates an annular flow path for production fluids moving from a surrounding subsurface formation towards an outer diameter of the base pipe during a subsurface production operation.

The first sand screen assembly also includes a first coupling assembly operatively connected at the first end of the base pipe, and a second coupling assembly operatively connected at the second end of the base pipe. Each coupling assembly comprises a manifold that receives gravel slurry from transport conduits across adjacent sand screen assemblies during a gravel packing operation.

The first sand screen assembly also includes one or more shunt tubes, or "transport conduits," residing along the outer diameter of the base pipe in the annular flow path. The transport conduits each define a bore for communicating gravel slurry to the first and second coupling assemblies.

The first sand screen assembly further includes an in-flow control section. The in-flow control section selectively permits fluid leak-off to flow into the bore of the base pipe during a gravel packing operation, and production fluids to flow into the bore of the base pipe during a production operation. In one embodiment, the in-flow control-section comprises at least one gravel packing opening in the base pipe. The gravel packing opening allows fluid communication for gravel slurry leak-off between the annular flow path and the bore of the base pipe during gravel packing. The in-flow control section forms a less restrictive flow path into the bore of the base pipe for gravel slurry leak-off during a gravel packing operation than for production fluids during a production operation.

The method 1300 includes running the first sand screen assembly into a wellbore. This is provided at Box 1310. The method 1300 then includes conducting a gravel packing operation. This is indicated at Box 1315. Fluid leak-off occurs as sand is packed around the sand screen assembly during the gravel packing operation.

The method 1300 further includes shutting off the flow path for gravel slurry leak-off in the in-flow control section. This is seen at Box 1320. Shutting off fluid flow is done after the gravel packing operation is completed.

The method 1300 also comprises conducting production operations for a period of time. This means that production fluids flow into the in-flow control section, into the base pipe, and up to the surface. This is seen at Box 1325.

In one aspect, the method 1300 further includes shutting off the flow path for production fluids in the in-flow control section after production operations have commenced. This is provided at Box 1330. Shutting off the flow path for production fluids in the in-flow control section may comprise, for example, actuating a sleeve or actuating a swellable packer to close off flow into the base pipe. Alternatively, shutting off the flow of production fluids may mean providing an autonomous ICD valve, and allowing the autonomous ICD valve to shut off flow in response to a sensed wellbore fluid property.

In one related embodiment, the first sand screen assembly further comprises at least one production opening in the first base pipe along the in-flow control section. The method 1300 then further comprises actuating a sleeve (or valve) in order to increase or decrease the flow of production fluids through the at least one production opening and into the bore of the first base pipe. This is shown at Box 1335. This may be done through a radio frequency signal, a mechanical shifting tool, or hydraulic pressure. The inflow control device may also be an autonomous device like the Equi-Flow® ICD valve from Halliburton Energy Services, Inc. of Houston, Tex., the RCP valve from StatOil of Stavanger, Norway, the FloSure™ in-flow control valve from Tendeka of Aberdeen, Scotland, or Inflow Control's AICV valve.

In another embodiment, the in-flow control section comprises production openings that are tuned to restrict the flow of production fluids into the bore of the base pipe after production operations have commenced. Thus, one might say that the method includes tuning the in-flow control section to establish a maximum flow area into the base pipe.

Preferably, the method 1300 also includes providing second and third sand screen assemblies. This is indicated at Box 1340. The second and third sand screen assemblies are constructed in accordance with the first sand screen assembly.

The method 1300 then includes operatively connecting the second sand screen assembly to the first end of the first sand screen assembly, and connecting the third sand screen assembly to the second opposite end of the first sand screen assembly. This is shown at Boxes 1345 and 1350. This is done by means of the first and second coupling assemblies, respectively. In one embodiment, the coupling assembly includes a load sleeve, a torque sleeve, and an intermediate coupling joint. The load sleeve, the torque sleeve, and the coupling joint form a coupling assembly as described above. Other sleeve arrangements may be offered.

In this instance, the method 1300 also includes running the third, first and second sand screen assemblies into the wellbore together before beginning the gravel packing operation. This is provided at Box 1355.

In one aspect, the method 1300 further comprises producing hydrocarbon fluids through the base pipes of the first and second base pipes from at least one interval along the wellbore. This is indicated at Box 1360. Producing hydrocarbon fluids causes hydrocarbon fluids to travel from the annular flow path, through the in-flow control section, into the base pipes, and up to the surface. The step 1360 of producing hydrocarbons may include adjusting the in-flow of production fluids into the base pipe in response to reservoir parameters or conditions. For example, an operator may desire to restrict the in-flow of production fluids along a zone of higher rock permeability or higher reservoir pressure in order to equalize flow along zones of interest.

Optionally, the method 1300 further includes providing a packer assembly between designated sand screen assemblies. This is seen at Box 1365. The packer assembly may include at least one, and preferably two, mechanically-set packers. These represent an upper packer and a lower packer. Each packer will have an inner mandrel, and a sealing element external to the inner mandrel. Each mechanically-set packer has a sealing element that may be, for example, from about 6 inches (15.2 cm) to 24 inches (61.0 cm) in length.

Alternatively or in addition, the packer assembly also includes at least one swellable sealing element. The swellable packer element is disposed intermediate a pair of mechanically-set packers or replaces the mechanically-set packers. The swellable packer element is preferably about 3 feet (0.91 meters) to 40 feet (12.2 meters) in length. In one aspect, the swellable packer element is fabricated from an elastomeric material. The swellable packer element is actuated over time in the presence of a fluid such as water, gas, oil, or a chemical. Swelling may take place, for example, should one of the mechanically-set packer elements fails. Alternatively, swelling may take place over time as fluids in the formation surrounding the swellable packer element contact the swellable packer element.

The above method 1300 may be used to selectively produce from, or even inject into, multiple zones. This provides enhanced subsurface production or injection control in a multi-zone completion wellbore.

While it will be apparent that the inventions herein described are well calculated to achieve the benefits and advantages set forth above, it will be appreciated that the inventions are susceptible to modification, variation and change without departing from the spirit thereof. Improved methods for completing an open-hole wellbore are provided so as to seal off or to at least limit production from one or more selected subsurface intervals by using or actuating an in-flow control section along a sand screen assembly.

What is claimed is:

1. A sand screen assembly residing within a wellbore, comprising:

a base pipe comprising a blank tubular body, the base pipe having a first end, a second end, and a bore there between forming a flow path for production fluids;

filter media disposed circumferentially around and residing along at least a portion of the base pipe, the filter media creating an annular flow path for production fluids moving from a surrounding subsurface formation towards an outer diameter of the base pipe during a subsurface production operation;

a first coupling assembly operatively connected at the first end of the base pipe, and a second coupling assembly operatively connected at the second end of the base pipe, wherein each coupling assembly comprises a manifold that receives gravel slurry from transport conduits across adjacent sand screen assemblies during a gravel packing operation;

one or more transport conduits residing along the outer diameter of the base pipe in the annular flow path, the transport conduits each having a bore for communicating gravel slurry to the first and second coupling assemblies during a gravel packing operation;

an in-flow control section disposed adjacent a coupling assembly along the base pipe comprising:

at least one gravel packing opening in the base pipe to allow fluid communication for gravel slurry leak-off between the annular flow path and the bore of the base pipe during a gravel packing operation;

one or more production fluids openings in the base pipe to allow fluid communication for production fluids between the annular flow path and the bore of the base pipe after production operations have commenced;

a cylindrical transition ring disposed between the at least one gravel packing opening and the one or more production fluid openings, the transition ring having (i) a body defining an inner diameter that sealingly receives the base pipe, and an outer diameter, (ii) radially-disposed openings around the body of the transition ring for transporting gravel slurry across adjacent sections of the filter media, and (iii) one or more fluid-flow conduits along the body for transporting wellbore fluids from the annular flow path around the base pipe to the at least one gravel packing opening or to the one or more production fluids openings;

an in-flow control device located along a flow path to the one or more production fluids openings; and an impermeable housing defining a blank tubular body that resides around the in-flow control section to force production fluids to flow exclusively into the one or more production fluids openings once the at least one gravel packing opening is closed, such that the in-flow control section forms a less restrictive flow path into the bore of the base pipe for gravel slurry leak-off during the gravel packing operation than for production fluids during the production operation;

wherein, the in-flow control section is configured to close off flow to the at least one gravel packing opening once gravel packing operations are completed.

2. The sand screen assembly of claim 1, wherein:

the in-flow control section is further configured to selectively reduce or shut off the flow path for production fluids at some time after production operations have commenced.

3. The sand screen assembly of claim 1, wherein the one or more production fluids openings are pre-tuned to restrict the flow of production fluids into the bore of the base pipe after production operations have commenced, as the in-flow control device.

4. The sand screen assembly of claim 1, wherein the one or more fluid-flow conduits along the transition ring are pre-tuned to restrict the flow of production fluids into the bore of the base pipe after production fluids have commenced, as the in-flow control device.

5. The sand screen assembly of claim 1, wherein:

the transition ring comprises a first transition ring and a second transition ring;

the at least one gravel packing opening in the base pipe resides between the first transition ring and the first end of the base pipe; and the one or more production fluids openings reside between the second transition ring and the second end of the base pipe.

6. The sand screen assembly of claim 1, wherein:

the transition ring comprises a first transition ring and a second transition ring;

the at least one gravel packing opening in the base pipe resides between the first transition ring and the second transition ring; and the one or more production fluids openings reside between the second transition ring and one of the first and second ends of the base pipe.

7. The sand screen assembly of claim 1, further comprising:

at least one cylindrical nozzle ring disposed along the base pipe intermediate sections of the filter media between the first end and the second end, the at least one nozzle ring having (i) a body defining an inner diameter that sealingly receives the base pipe, and an outer diameter, (ii) radially-disposed openings around the body of the nozzle ring for transporting gravel slurry across adjacent sections of the filter media, and (iii) one or more fluid-flow conduits along the body of the nozzle ring for transporting wellbore fluids across the annular flow paths of adjoining sections of the filter media.

8. The sand screen assembly of claim 7, wherein the in-flow control-section further comprises:

one of the at least one nozzle rings;

the one or more production fluids opening in the base pipe reside between a transition ring and the first end of the base pipe; and the at least one gravel packing opening resides between the nozzle ring and the second end of the base pipe.

9. The sand screen assembly of claim 7, wherein the in-flow control-section further comprises:

one of the at least one nozzle rings;

the one or more production fluids opening in the base pipe resides between a nozzle ring and the transition ring; and the at least one gravel packing opening resides between the transition ring and one of the first and second ends of the base pipe.

10. A sand screen assembly residing within a wellbore, comprising:

a first base pipe comprising a blank tubular body, the base pipe having a first end, a second end, and a bore there between forming a flow path for production fluids;

filter media disposed circumferentially around and residing along at least a portion of the base pipe, the filter media creating an annular flow path for production fluids moving from a surrounding subsurface formation towards an outer diameter of the base pipe;

at least one gravel packing opening in the base pipe to allow fluid communication for gravel slurry leak-off between the bore of the base pipe and the annular flow path during a gravel packing operation;

one or more transport conduits residing along the outer diameter of the first base pipe in the annular flow path, the transport conduits each having a bore for providing an alternate flow path for gravel slurry during the gravel packing operation;

a first coupling assembly operatively connected at the first end of the base pipe, and a second coupling assembly operatively connected at the second end of the base pipe, wherein each coupling assembly comprises a manifold that receives gravel slurry from the transport conduits across adjacent sand screen assemblies;

at least one cylindrical nozzle ring disposed along the base pipe intermediate sections of the filter media between the first end and the second end, the at least one nozzle ring having (i) a body defining an inner diameter that sealingly receives the base pipe, and an outer diameter, (ii) gravel packing openings around the body of the nozzle ring for transporting gravel slurry across adjacent sections of the filter media, and (iii) one or more fluid-flow conduits along the body of the nozzle ring for transporting wellbore fluids across the annular flow paths of adjoining sections of the filter media; and an in-flow control section configured to permit fluid leak-off to flow into the bore of the base pipe during a gravel packing operation, and production fluids to flow into the bore of the base pipe during a production operation, wherein the in-flow control section is configured to shut off the flow path for gravel slurry leak-off after the gravel packing operation is completed.

11. The sand screen assembly of claim 10, wherein the in-flow control section forms a less restrictive flow path into the bore of the base pipe for gravel slurry leak-off during a gravel packing operation than for production fluids during a production operation.

12. The sand screen assembly of claim 11, wherein the in-flow control section comprises:

an in-flow control device for controlling the flow of production fluids from the annular flow path of a section of filter media into the bore of the first base pipe; and a cylindrical transition ring disposed adjacent one of the coupling assemblies along the base pipe, the transition ring having (i) a body defining an inner diameter that sealingly receives the base pipe, and an outer diameter, (ii) openings around the body of the transition ring for transporting gravel slurry across adjacent sections of the filter media, and (iii) one or more fluid-flow conduits along the body for transporting wellbore fluids from the annular flow path around the base pipe to the in-flow control device during production operations.

13. The sand screen assembly of claim 12, wherein the filter media comprises a wire-wrapped screen or a slotted ceramic screen.

14. The sand screen assembly of claim 12, wherein:

the first end of the first base pipe is operatively connected to a second base pipe that is associated with a second adjacent sand control assembly; and the second end of the first base pipe is operatively connected to a third base pipe that is associated with a third adjacent sand control assembly.

15. The sand screen assembly of claim 14, wherein the first coupling assembly comprises:

a first sleeve mechanically connected proximate to the first end of the first base pipe;

a second sleeve configured to be mechanically connected to a second end of the second adjoining base pipe opposite the first sleeve of the first coupling assembly; and an intermediate coupling joint comprising a main tubular body defining a bore in fluid communication with the bore of the first and second base pipes, the main tubular body having a first end and a second end, wherein the first end is threadedly connected to the first end of the first base pipe, and the second end is threadedly connected to the second end of the second base pipe.

16. The sand screen assembly of claim 15, wherein the second coupling assembly comprises:

a first sleeve mechanically connected proximate to the second end of the first base pipe;

a second sleeve configured to be mechanically connected to a first end of the third adjoining base pipe opposite the first sleeve of the second coupling assembly; and an intermediate coupling joint comprising a main tubular body defining a bore in fluid communication with the bore of the first and third base pipes, the main tubular body having a first end and a second end, wherein the first end is threadedly connected to the second end of the first base pipe, and the second end is threadedly connected to the first end of the third base pipe.

17. The sand screen assembly of claim 16, wherein:

the first and second coupling assemblies threadedly connect the second base pipe, the first base pipe and the third base pipe together to form a linear series of sand screen assemblies, with each sand screen assembly being in accordance with the sand screen assembly of claim 10.

18. The sand screen assembly of claim 16, wherein:

(i) the first sleeve in the first coupling assembly is a load sleeve and the second sleeve in the first coupling assembly is a torque sleeve, or (ii) the first sleeve in the first coupling assembly is a torque sleeve and the second sleeve in the first coupling assembly is a load sleeve; and each sleeve comprises a tubular body having a plurality of transport channels therein for transporting gravel slurry.

19. The sand screen assembly of claim 17, wherein:

the first sleeve in the first coupling assembly is a load sleeve and the second sleeve in the first coupling assembly is a torque sleeve;

the load sleeve and the torque sleeve in the first coupling assembly each comprises:

a main tubular body defining an inner bore therein in fluid communication with the bore of the first base pipe, and transport channels disposed longitudinally along the main tubular body for transporting gravel slurry; and the coupling assembly further comprises:

a co-axial sleeve positioned around the main tubular body, the co-axial sleeve forming an annual region between the main tubular body and the coaxial sleeve, with the annular region defining the manifold, and the manifold placing the transport conduits of the load sleeve and of the torque sleeve in fluid communication.

20. The sand screen assembly of claim 17, wherein the transition ring in the in-flow control section resides between a nozzle ring and the first sleeve of the first coupling assembly.

21. The sand screen assembly of claim 20, further comprising:

an impermeable housing defining a blank tubular body that resides around the in-flow control section; and wherein the at least one gravel packing opening in the first base pipe and the fluid-flow openings around the body of the transition ring for transporting gravel slurry leak-off together form a less restrictive flow path for gravel slurry leak-off during a gravel packing operation than the in-flow control device.

22. The sand screen assembly of claim 21, wherein the in-flow control device comprises the one or more fluid-flow conduits along the body of the transition ring for transporting wellbore fluids from the annular flow path around the first base pipe, wherein the one or more fluid-flow conduits form a fluid flow area that is pre-tuned to control a flow rate of production fluids from the annular flow path, to the production fluids openings, and into the bore of the first base pipe.

23. The sand screen assembly of claim 21, wherein:

the at least one gravel packing opening in the first base pipe resides between the nozzle ring and the transition ring;

the in-flow control section comprises one or more production fluids openings in the first base pipe; and the one or more production fluids openings resides between the transition ring and the first sleeve of the first coupling assembly.

24. The sand screen assembly of claim 23, wherein the first sleeve is a torque sleeve or a load sleeve.

25. The sand screen assembly of claim 21, wherein the at least one gravel packing opening is configured to be selectively closed after a gravel packing operation is completed.

26. The sand screen assembly of claim 21, wherein:

the one or more in-flow control devices comprises at least one nozzle defining a production fluids opening in the first base pipe;

the at least one nozzle forms a flow area that is pre-tuned to control a flow rate of production fluids from the annular flow path into the bore of the first pipe; and (i) the fluid-flow openings in the transition ring used for transporting wellbore fluids are configured to be closed after a gravel packing operation is completed, (ii) the at least one gravel packing opening in the first base pipe is configured to be closed after a gravel packing operation is completed, or (iii) both.

27. The sand screen assembly of claim 26, wherein:

the in-flow control section comprises one or more production fluids openings in the first base pipe;

the one or more production fluids openings resides between the transition ring and the nozzle ring; and the at least one gravel packing opening resides between the transition ring and the first sleeve of the first coupling assembly.

28. The sand screen assembly of claim 27, wherein the first sleeve is a torque sleeve or a load sleeve.

29. The sand screen assembly of claim 28, wherein the openings around the body of the nozzle ring for transporting gravel slurry comprise six to nine transport conduits that are generally equi-distantly spaced around the body of the nozzle ring.

30. The sand screen assembly of claim 29, wherein:

the openings around the body of the nozzle ring for transporting gravel slurry comprise six transport channels and three packing channels;

the six transport channels are symmetric circumferentially; and the three packing channels are symmetric circumferentially.

31. The sand screen assembly of claim 29, wherein:

the one or more fluid-flow conduits along the body of the nozzle ring for transporting wellbore fluids comprises four to six flow conduits; and the four to six fluid-flow conduits are spaced apart to accommodate the transport conduits.

32. The sand screen assembly of claim 31, wherein the one or more production fluids openings in the first base pipe:

resides adjacent the nozzle ring; and comprises an autonomous in-flow control device.

33. The sand screen assembly of claim 32, wherein:

the one or more fluid-flow conduits along the body of the nozzle ring for transporting wellbore fluids comprises three sets of two flow conduits spaced apart circumferentially at 60 degrees to accommodate the autonomous in-flow control device;

the openings around the body of the nozzle ring for transporting gravel slurry comprise nine channels spaced asymmetrically; and the autonomous in-flow control device comprises at least one opening along the first base pipe that may be selectively flow-restricted.

34. A method for completing a wellbore in a subsurface formation, the method comprising:

providing a first sand screen assembly, the first sand screen assembly comprising:

a base pipe comprising a blank tubular body, the base pipe having a first end, a second end, and a bore there between forming a flow path for production fluids;

filter media disposed circumferentially around and residing along at least a portion of the base pipe, the filter media creating an annular flow path for production fluids moving from a surrounding subsurface formation towards an outer diameter of the base pipe during a subsurface production operation;

a first coupling assembly operatively connected at the first end of the base pipe, and a second coupling assembly operatively connected at the second end of the base pipe, wherein each coupling assembly comprises a manifold that receives gravel slurry from transport conduits across adjacent sand screen assemblies during a gravel packing operation; and an in-flow control section disposed adjacent a coupling assembly along the base pipe that selectively permits fluid leak-off to flow into the bore of the base pipe during a gravel packing operation, and production fluids to flow into the bore of the base pipe during a production operation, the in-flow control section comprising:

at least one gravel packing opening in the base pipe to allow fluid communication for gravel slurry leak-off between the annular flow path and the bore of the base pipe during a gravel packing operation;

one or more production fluids openings in the base pipe to allow fluid communication for production fluids between the annular flow path and the bore of the base pipe after production operations have commenced;

a cylindrical transition ring disposed between the at least one gravel packing opening and the one or more production fluid openings, the transition ring having (i) a body defining an inner diameter that sealingly receives the base pipe, and an outer diameter, (ii) radially-disposed openings around the body of the transition ring for transporting gravel slurry across adjacent sections of the filter media, and (iii) one or more fluid-flow conduits along the body for transporting wellbore fluids from the annular flow path around the base pipe to the at least one gravel packing opening or to the one or more production fluids openings;

an in-flow control device located along a flow path to the one or more production fluids openings; and an impermeable housing defining a blank tubular body that resides around the in-flow control section to force production fluids to flow exclusively into the one or more production fluids openings once the at least one gravel packing opening is closed;

running the first sand screen assembly into a wellbore;

conducting a gravel packing operation, wherein fluid leak-off occurs as sand is packed around the sand screen assembly;

shutting off the flow path for gravel slurry leak-off in the in-flow control section after the gravel packing operation is completed; and producing wellbore fluids through the one or more production fluids openings.

35. The method of claim 34, further comprising:

shutting off the flow path for production fluids in the in-flow control section after production operations have commenced.

36. The method of claim 35, wherein shutting off the flow path for production fluids in the in-flow control section comprises actuating a sleeve or actuating a swellable packer along the base pipe.

37. The method of claim 34, further comprising: actuating a sleeve in order to increase or decrease the flow of production fluids through the one or more production fluids opening and into the bore of the first base pipe.

38. The method of claim 34, wherein the in-flow control section forms a less restrictive flow path into the bore of the base pipe for gravel slurry leak-off during the gravel packing operation than for production fluids during the production operation.

39. The method of claim 34, wherein the one or more production fluids openings are pre-tuned to restrict the flow of production fluids into the bore of the base pipe after production operations have commenced, as the in-flow control device.

40. The method of claim 38, wherein the first sand screen assembly further comprises:

one or more transport conduits residing along the outer diameter of the base pipe in the annular flow path, the transport conduits each having a bore for communicating gravel slurry to the first and second coupling assemblies.

41. The method of claim 40, wherein the first sand screen assembly further comprises:

at least one cylindrical nozzle ring disposed along the base pipe intermediate sections of the filter media between the first end and the second end, the at least one nozzle ring having (i) a body defining an inner diameter that sealingly receives the base pipe, and an outer diameter, (ii) openings around the body of the nozzle ring for transporting gravel slurry across adjacent sections of the filter media, and (iii) one or more fluid-flow conduits along the body of the nozzle ring for transporting wellbore fluids across the annular flow paths of adjoining sections of the filter media.

42. The method of claim 41, further comprising:

connecting the first coupling assembly to the first end of the first sand screen assembly; and connecting the second coupling assembly to the second end of the first sand screen assembly.

43. The method of claim 42, further comprising:

providing a second sand screen assembly and a third sand screen assembly, wherein each of the second and third sand screen assemblies is constructed in accordance with the first sand screen assembly;

operatively connecting the second sand screen assembly to the first sand screen assembly at the first end of the base pipe by means of the first coupling assembly;

operatively connecting the third sand screen assembly to the first sand screen assembly at the second end of the base pipe by means of the second coupling assembly; and running the third, first and second sand screen assemblies into the wellbore together before beginning the gravel packing operation.

44. The method of claim 43, wherein:

the base pipe is a first base pipe;

the first end of the first base pipe is operatively connected to a second base pipe that is associated with a second adjacent sand control assembly; and the second end of the first base pipe is operatively connected to a third base pipe that is associated with a third adjacent sand control assembly opposite the second sand screen assembly; and the first coupling assembly comprises:

a first sleeve mechanically connected proximate to the first end of the first base pipe;

a second sleeve mechanically connected proximate to a second end of the second adjoining base pipe opposite the first sleeve of the first coupling assembly; and an intermediate coupling joint comprising a main tubular body defining a bore in fluid communication with the bore of the first and second base pipes, the main tubular body having a first end and a second end, wherein the first end is threadedly connected to the first end of the first base pipe, and the second end is threadedly connected to the second end of the second base pipe.

45. The method of claim 44, wherein the second coupling assembly comprises:

a first sleeve mechanically connected proximate to the second end of the first base pipe;

a second sleeve mechanically connected proximate to a first end of the third adjoining base pipe opposite the first sleeve of the second coupling assembly; and an intermediate coupling joint comprising a main tubular body defining a bore in fluid communication with the bore of the first and third base pipes, the main tubular body having a first end and a second end, wherein the first end is threadedly connected to the second end of the first base pipe, and the second end is threadedly connected to the first end of the third base pipe; and wherein the first and second coupling assemblies threadedly connect the second base pipe, the first base pipe and the third base pipe together to form a linear series of sand screen assemblies, with each sand screen assembly being in accordance with the sand screen assembly of claim 32.

46. The method of claim 45, wherein:

(i) the first sleeve in the first coupling assembly is a load sleeve and the second sleeve in the first coupling assembly is a torque sleeve, or (ii) the first sleeve in the first coupling assembly is a torque sleeve and the second sleeve in the first coupling assembly is a load sleeve; and each sleeve comprises a tubular body having a plurality of transport channels therein for transporting gravel slurry during a gravel packing operation.

47. The method of claim 41, wherein the transition ring in the in-flow control section resides between a nozzle ring and the first sleeve of the first coupling assembly.

48. The method of claim 47, wherein the one or more fluid-flow conduits along the transition ring form a fluid flow area that is pre-tuned to control a flow rate of production fluids from the annular flow path, to the production fluids openings, and into the bore of the first base pipe after production operations have commenced, as the in-flow control device.

49. The method of claim 47, wherein:

the at least one gravel packing opening in the first base pipe resides between the nozzle ring and the transition ring; and the one or more production fluids openings resides between the transition ring and the first sleeve of the first coupling assembly.

50. The method of claim 49, wherein shutting off the flow path for gravel slurry leak-off in the in-flow control section comprises closing the at least one gravel packing opening.

51. The method of claim 47, wherein:

the one or more production fluids openings comprise at least one nozzle or at least one autonomous in-flow control device for defining the production fluids openings in the first base pipe;

the at least one nozzle forms a flow area that is pre-tuned to control a flow rate of production fluids from the annular flow path into the bore of the first pipe; and shutting off the flow path for gravel slurry leak-off in the in-flow control section comprises closing (i) the openings in the transition ring used for transporting gravel slurry leak-off, (ii) the at least one gravel packing opening in the first base pipe, or (iii) both.

52. The method of claim 51, wherein:

the one or more production fluids openings resides between the transition ring and the nozzle ring; and the at least one gravel packing openings resides between the transition ring and the first sleeve of the first coupling assembly.

53. The method of claim 52, wherein the first sleeve is a torque sleeve or a load sleeve.

* * * * *